US008888011B2

(12) United States Patent
Miura et al.

(10) Patent No.: US 8,888,011 B2
(45) Date of Patent: Nov. 18, 2014

(54) CONTROLLER AND BOILER SYSTEM

(75) Inventors: Koji Miura, Matsuyama (JP); Kazuya Yamada, Matsuyama (JP)

(73) Assignee: Miura Co., Ltd., Matsuyama-shi (JP)

( * ) Notice: Subject to any disclaimer, the term of this patent is extended or adjusted under 35 U.S.C. 154(b) by 783 days.

(21) Appl. No.: 13/173,548

(22) Filed: Jun. 30, 2011

(65) Prior Publication Data

US 2012/0006285 A1 Jan. 12, 2012

(30) Foreign Application Priority Data

Jul. 9, 2010 (JP) ..... 2010-156646

(51) Int. Cl.
*F22B 37/42* (2006.01)
*F01K 13/02* (2006.01)

(52) U.S. Cl.
CPC ..... *F01K 13/02* (2013.01)
USPC ..... 236/14; 122/448.3

(58) Field of Classification Search
CPC . F22B 35/008; F24D 12/02; F24D 2200/043; F22D 5/36
USPC ..... 236/14, 20 R; 122/448.1, 448.3
See application file for complete search history.

(56) References Cited

U.S. PATENT DOCUMENTS

| | | | | | |
|---|---|---|---|---|---|
| 3,387,589 | A * | 6/1968 | Chan et al. | 122/1 R |
| 4,418,541 | A * | 12/1983 | Russell | 60/667 |
| 4,534,321 | A * | 8/1985 | Rydborn | 122/448.3 |
| 4,860,696 | A * | 8/1989 | Fujita | 122/448.3 |
| 5,172,654 | A * | 12/1992 | Christiansen | 122/448.3 |
| 5,665,710 | A * | 9/1997 | Rahman et al. | 514/44 A |
| 8,682,490 | B2 * | 3/2014 | Yamada et al. | 700/274 |
| 2011/0162593 | A1 | 7/2011 | Miura | |

FOREIGN PATENT DOCUMENTS

| | | | |
|---|---|---|---|
| CN | 201514562 | U | 6/2010 |
| JP | H08-049803 | A | 2/1996 |
| JP | 9-287703 | A | 11/1997 |
| JP | 2005-55014 | A | 3/2005 |
| JP | 2010-048462 | A | 3/2010 |
| JP | 2010-48533 | A | 3/2010 |
| JP | 2010-091139 | A | 4/2010 |

* cited by examiner

*Primary Examiner* — Marc Norman
(74) *Attorney, Agent, or Firm* — Fox Rothschild LLP

(57) ABSTRACT

A controller includes a program for controlling a group of boilers having boilers with a plurality of staged combustion positions. The program is arranged to control the boilers and the combustion positions such that a total load following evaporation amount obtained by summing up load following evaporation amounts of the respective boilers comprising the group of boilers becomes equal to or more than a setup load following evaporation amount which is an evaporation amount that the group of boilers is to follow.

26 Claims, 14 Drawing Sheets

Fig. 3

| | | | | | | | | | | | | | | | | |
|---|---|---|---|---|---|---|---|---|---|---|---|---|---|---|---|---|
| 2 | 2000 | 0 | 0 | 0 | 1000 | 0 | 0 | 0 | 1000 | 0 | 0 | 0 | 1000 | 0 | 0 | 0 |
| 1 | 1000 | 2000 | 2000 | 2000 | 500 | 1000 | 1000 | 1000 | 500 | 1000 | 1000 | 1000 | 1000 | 1000 | 1000 | 1000 |
| 0 | 0 | — | 1000 | 3000 | 0 | — | 500 | 1500 | 0 | — | 500 | 1500 | 0 | — | 1000 | 2000 |
| j / i | J21 (j) | G21A (j) | G21B (j) | G21C (j) | J22 (j) | G22A (j) | G22B (j) | G22C (j) | J23 (j) | G23A (j) | G23B (j) | G23C (j) | J24 (j) | G24A (j) | G24B (j) | G24C (j) |
| | 21 | | | | 22 | | | | 23 | | | | 24 | | | |

Fig. 8

| | | | | | | | | | | | | |
|---|---|---|---|---|---|---|---|---|---|---|---|---|
| 3 | 2000 | 0 | 0 | 0 | 1500 | 0 | 0 | 0 | — | — | — | — |
| 2 | 1000 | 2000 | 2000 | 2000 | 1500 | 1500 | 1500 | 1500 | 1500 | 0 | 0 | 0 |
| 1 | 500 | 3000 | 3000 | 3000 | 1000 | 3000 | 3000 | 3000 | 500 | 1500 | 1500 | 1500 |
| 0 | 0 | — | 500 | 3500 | 0 | — | 1000 | 4000 | 0 | — | 500 | 2000 |
| j / i | JF1(j) | GF1A(j) | GF1B(j) | GF1C(j) | JF2(j) | GF2A(j) | GF2B(j) | GF2C(j) | JF3(j) | GF3A(j) | GF3B(j) | GF3C(j) |
| | F1 | | | | F2 | | | | F3 | | | |

Fig. 11

| No. of combination of combustion positions | | 1 | 2 | 3 | 4 | 5 | 6 | 7 | 8 |
|---|---|---|---|---|---|---|---|---|---|
| F1 | F1 (1) | During combustion | During combustion | During combustion | During combustion | During combustion | During combustion | During combustion | During combustion |
| | F1 (2) | ○ | | ○ | ○ | | ○ | ○ | ○ |
| | F1 (3) | | | | ○ | | ○ | | ○ |
| F2 | F2 (1) | | ○ | ○ | | ○ | ○ | ○ | ○ |
| | F2 (2) | | | | | ○ | | ○ | ○ |
| | F2 (3) | Reserve can | Reserve can | Reserve can | Reserve can | Reserve can | Reserve can | Reserve can | Reserve can |
| F3 | F3 (1) | During combustion | During combustion | During combustion | During combustion | During combustion | During combustion | During combustion | During combustion |
| | F3 (2) | Reserve can | Reserve can | Reserve can | Reserve can | Reserve can | Reserve can | Reserve can | Reserve can |
| Total evaporation amount JR (Kg/h) | | 2000 | 2000 | 3000 | 4000 | 3500 | 5000 | 4500 | 6500 |
| Total load following evaporation amount JG (Kg/h) | | 2000 | 4500 | 3500 | Zero | 3000 | 1500 | 2000 | Zero |

Fig. 15

| Operation order | Required evaporation amount JN (kg/h) | Total evaporation amount JR | Total load following evaporation amount JG |
|---|---|---|---|
| 1 | — | 1000 (kg/h) | 2000 (kg/h) |
| 2 | — | 2000 (kg/h) | 4000 (kg/h) |
| 3 | More than 2000 and not more than 3000 | 3000 (kg/h) | 6000 (kg/h) |
| 4 | More than 3000 and not more than 4000 | 4000 (kg/h) | 5000 (kg/h) |
| 5 | More than 4000 and not more than 5000 | 5000 (kg/h) | 4000 (kg/h) |
| 6 | More than 5000 and not more than 6000 | 6000 (kg/h) | 5000 (kg/h) |
| 7 | More than 6000 and not more than 7000 | 7000 (kg/h) | 4000 (kg/h) |
| 8 | More than 7000 and not more than 8000 | 8000 (kg/h) | 3000 (kg/h) |
| 9 | More than 8000 and not more than 9000 | 9000 (kg/h) | 2000 (kg/h) |
| 10 | More than 9000 and not more than 10000 | 10000 (kg/h) | 1000 (kg/h) |
| 11 | More than 10000 and not more than 11000 | 11000 (kg/h) | — |

CONTROLLER AND BOILER SYSTEM

INCORPORATION BY REFERENCE

The present application claims priority under 35 U.S.C. §119 to Japanese Patent Application No. 2010-156646 filed Jul. 9, 2010. The content of the application is incorporated herein by reference in its entirety.

BACKGROUND OF THE INVENTION

1. Field of the Invention

The present invention relates to a controller for controlling a group of boilers having a plurality of boilers and to a boiler system.

2. Description of the Related Art

There is known a technique for controlling a group of boilers including boilers with a plurality of staged combustion positions to increase the evaporation amount to correspond to the required load by increasing the number of combustion boilers, and by moving the respective boilers to higher combustion positions.

There is also known a technique in which for the purpose of improving load following capabilities of the group of boilers, boilers with higher load following capabilities from among the group of boilers undergo combustion control on a priority basis.

SUMMARY OF THE INVENTION

However, in operating the group of boilers, it may become necessary to change the priority order where such a priority order is set for the respective boilers (or the combustion positions) or to change boilers that are subject to operation at the time of replacing reserve cans.

In this way, where changes in operating conditions of the group of boilers including changes in priority order or in boilers that are subject to operation have taken place, it might be that load following capabilities are degraded even though the required evaporation amount of the group of boilers is secured.

For instance, also in case of a simple group of boilers having the same type of boilers with the same number of combustion positions and the same differential evaporation amounts of the respective combustion positions, where changes in operating conditions of the group of boilers including changes in priority order or boilers that are subject to operation have taken place, it might be necessary to check the number of low combustion priority boilers for securing load following capabilities or whether boilers that maintain pressure (pressure keeping) in the steam supply moving process are sufficient for securing load following capabilities and to consequently change settings of the respective boilers, and setting operating conditions for the group of boilers might be troublesome.

Further, where the group of boilers is configured to include dissimilar boilers which at least either one of the number of combustion positions or differential evaporation amounts of the respective combustion positions differs, it might be that large fluctuations are caused in the load following capabilities of the group of boilers in response to changes in the priority order or boilers that are subject to operation as shown, for instance, in FIG. 16.

Here, in FIG. 16, each of the frames marked with reference numbers Nos. 1 to 5 indicates a single boiler, and frames partitioning the respective boilers represent combustion positions of the respective boilers, wherein shaded frames represent that the combustion positions are currently combusting and numbers within the frames indicate differential evaporation amounts of the combustion positions. Numbers indicated in brackets upward of the frames indicating the respective boilers represent priority orders within the group of boilers, wherein in the present prior art, the boilers are arranged to move from combustion standstill conditions to low combustion conditions in accordance with the priority order, and when all of the boilers that are subject to operation are in low combustion conditions, to sequentially move to high combustion conditions in accordance with this priority order.

For instance, in a group of boilers in which the priority order is set to be higher in the order from boiler No. 1 to boiler No. 5 as shown in FIG. 16A wherein boilers of fourth and fifth priority are defined to be reserve cans, when the priority order is changed to be higher from boiler No. 5 to boiler No. 1 in this order as shown in FIG. 16B, the high combustion condition of boiler No. 1 and the low combustion condition of boiler No. 2 are first maintained, but upon decrease of the required evaporation amount, boiler No. 1 changes from the high combustion condition to a low combustion condition and then to a combustion standstill condition (reserve can) and thereafter, boiler No. 2 changes from the low combustion condition to the combustion standstill condition (reserve can) in accordance with the priority order as shown in FIG. 16C.

Thereafter (or in the course in which the evaporation amount of the boiler No. 1 and the boiler No. 2 sequentially decrease), when the required evaporation amount of the group of boilers increases, the evaporation amount increases in the order of the low combustion condition of boiler No. 5, the low combustion condition of boiler No. 4 and the high combustion condition of boiler No. 5 as shown in FIG. 16D.

In comparing FIG. 16A and FIG. 16D, one boiler is in a high combustion condition and two boilers are in a low combustion condition in both of the group of boilers, but the maximum evaporation amount is 5000 (kg/h), the total evaporation amount 3500 (kg/h) and the total load following evaporation amount 1500 (kg/h) in FIG. 16A whereas these values largely change to a maximum evaporation amount of 3000 (kg/h), a total evaporation amount of 2000 (kg/h) and a total load following evaporation amount 1000 (kg/h) in FIG. 16D.

In this manner, it might be that large fluctuations in the load following capabilities are caused even if it is possible to secure the required evaporation amount when arrangements of boilers constituting the group of boilers (differences in numbers of combustion positions or in differential evaporation amounts of the respective combustion positions) or operating conditions of the group of boilers including changes in priority order or in boilers that are subject to operation fluctuate.

The present invention has been made in view of these circumstances, and it aims to provide a controller and a boiler system with which it is possible to easily secure load following capabilities when operating conditions of a group of boilers having boilers with a plurality of staged combustion positions.

For solving the above problem, the present invention suggests the following means.

The invention according to one embodiment is a controller comprising a program for controlling a group of boilers having boilers with a plurality of staged combustion positions, the program being arranged to control the respective boilers and the combustion positions such that a total load following evaporation amount obtained by summing up the load following evaporation amounts of each of the boilers constituting the group of boilers becomes equal to or more than a setup load following evaporation amount which is an evaporation amount that is to be followed by the group of boilers.

According to the controller of the present invention, the boilers and combustion positions are controlled such that the total load following evaporation amount of the group of boilers becomes equal to or more than the setup load following evaporation amount so that the load following capabilities of the group of boilers can be easily secured even if operating conditions of the boiler are changed.

In the descriptions, 1) the term "evaporation amount" denotes an amount of steam that is generated per unit hour, and it might be represented by, for instance, (kg/h).

2) The term "evaporation amount of a boiler" denotes an evaporation amount that is output by a combusting boiler at a current combustion position.

3) The term "total evaporation amount of the group of boilers" denotes a sum of evaporation amounts that are output by the boilers during combustion in the group of boilers at their current combustion positions.

4) The term "maximum evaporation amount of a boiler" denotes an evaporation amount that can be output by a boiler that is to be subject to operation and is a rated evaporation amount.

5) The term "maximum amount of evaporation amounts of the group of boilers" denotes an evaporation amount that can be output by the group of boilers and is a sum of maximum evaporation amounts of the boilers constituting the group of boilers (except for reserve cans), and it is also a rated evaporation amount as a group of boilers.

6) The term "load following evaporation amount" denotes an evaporation amount that either one of the boilers can increase within a short period of time without occurrence of any time lags in accordance with increases/decreases in the required load.

7) The term "total load following evaporation amount" denotes an evaporation amount that the group of boilers can increase within a short period of time without occurrence of any time lags in accordance with increases/decreases in the required load, and is a sum of load following evaporation amounts of the boilers constituting the group of boilers (expect for reserve cans).

The invention according to another embodiment is a controller comprising a program for controlling a group of boilers having boilers with a plurality of staged combustion positions, the program being arranged to control the respective boilers and the combustion positions such that a total load following evaporation amount obtained by summing the load following evaporation amounts of each of the boilers constituting the group of boilers is within a setup range for a load following evaporation amount of an evaporation amount that is to be followed by the group of boilers.

According to the controller of the present invention, the respective boilers and combustion positions are controlled such that the total load following evaporation amount of the group of boilers is within a setup range for a load following evaporation amount so that the load following capabilities of the group of boilers can be easily secured even if operating conditions of the boilers are changed, and that excess energy consumption can be suppressed by suppressing holding of an excess load following evaporation amount.

The invention according to yet another embodiment is a boiler system including the controller according to the above one embodiment or the above another embodiment.

According to the boiler system of the present invention, it is possible to easily secure load following capabilities of the group of boilers even upon changing operating conditions of the boilers.

One aspect of the invention is the controller in the above one embodiment or the above another embodiment, wherein, in summing up the total load following evaporation amount, the program is arranged to perform calculation with objects of calculation being evaporation amounts that increase when the boilers during combustion are moved from the combustion positions during combustion to the highest combustion positions.

According to the controller of the present invention, the total load following evaporation amount is secured with objects of calculation being evaporation amounts that increase when boilers that supply steam at combustion positions that are lower than the highest combustion positions are moved from current combustion positions during combustion to their highest combustion positions so that it is possible to increase the evaporation amount in a short period of time and thus to easily and reliably increase the load following capabilities.

In the descriptions, the highest combustion positions in calculating "the evaporation amount that increases upon moving to the highest combustion positions" are defined to be highest combustion positions of the respective boilers that are subject to operation at the time of calculating the load following evaporation amount.

Another aspect of the invention is the controller in the above one embodiment or the above another embodiment, wherein, in summing up the total load following evaporation amount, the program is arranged to perform calculation with objects of calculation being evaporation amounts that increase when the boilers during combustion are moved from the combustion positions during combustion to highest combustion positions and evaporation amounts that increase when boilers during steam supply moving processes are moved to the lowest combustion positions.

According to the controller of the present invention, the total load following evaporation amount is secured with objects of calculation being evaporation amounts that increase when boilers that supply steam at combustion positions that are lower than the highest combustion positions are moved from the combustion positions during combustion to the highest combustion positions as well as the evaporation amounts that increase when boilers in steam supply moving processes are moved to lowest combustion positions (corresponding to first differential evaporation amounts) so that even if a boiler during steam supply moves to a higher combustion position, the load following evaporation amount increases by an amount corresponding to this first differential evaporation amount of the boiler by moving any one boiler to the steam supply moving process, and it is accordingly possible to easily and effectively improve the load following capabilities of the group of boilers.

In the descriptions, a difference between an evaporation amount that increases when a boiler is moved to a combustion position that is higher by one stage, that is, an evaporation amount at a combustion position after moving the combustion position and an evaporation amount of a combustion standstill position (or combustion position) prior to moving is referred to as a differential evaporation amount.

Further, an evaporation amount that increases by moving higher by one stage to become the N-th combustion position (where N is an integer that is 1 or more) is defined to be a "differential evaporation amount at the N-th combustion position" or "the N-th differential evaporation amount", and for instance, an evaporation amount that increases by moving from a combustion standstill position to the first combustion position is defined to be "the differential evaporation amount at the first combustion position" or "the first differential evaporation amount", and the evaporation amount that increases by moving from the first combustion position to the second combustion position is defined to be "the differential evaporation amount at the second combustion position" or "the second differential evaporation amount".

Further, in the descriptions, a "steam supply moving process" is a process in which a boiler that is, for instance, in a purge condition (including light air purge) or pilot combustion condition (including continuous pilot combustion) starts combustion until it supplies steam at the first combustion position, a process in which a burner corresponding to low combustion starts combustion until it supplies steam at the first combustion position, and a process in which a boiler which combustion has been cancelled reaches a combustion standstill position and the water temperature reduces to room temperature, and these processes can be classified into the following first to fifth conditions, wherein steam supply can be performed within shorter times from the first condition to fifth condition in this order.

First condition: a condition at a low combustion position wherein pressure is maintained though no steam supply is performed.

Second condition: a purge or pilot combustion condition after cancelling low combustion wherein pressure is maintained though no steam supply is performed.

Third condition: a condition which is a standby condition upon cancelling the low combustion condition wherein pressure is maintained though no steam supply is performed.

Fourth condition: a condition in which the position has been moved from the combustion standstill position to the low combustion position wherein water is heated but no pressure is maintained (pressure-less condition).

Fifth condition: a purge or pilot combustion condition wherein no pressure is maintained (pressure-less condition).

It should be noted that the fifth condition includes a cases in which a pressure-less condition has been reached through pressure decrease from the second condition and also a pressure-less condition that is caused through purge or pilot combustion conditions at combustion standstill positions. From among the steam supply moving processes, movements to the first combustion position starting from the first condition, the second condition and the third condition in pressure maintaining conditions are favorable in view of shortening the moving time.

In this respect, a "continuous pilot combustion condition" denotes a continuous combustion condition of a pilot burner for preventing accumulation of unburned gas in the can such that ignition can be immediately performed upon output of a combustion signal.

In this respect, a "light air purge" denotes a condition in which a blast condition is maintained at a minute amount of air by reducing the rotating speed of an air blower for preventing accumulation of unburned gas in the can such that ignition can be immediately performed upon output of a combustion signal.

Yet another aspect of the invention is the controller in the above one embodiment or the above another embodiment, wherein, in summing up the total load following evaporation amount, the program is arranged to perform calculation with objects of calculation being evaporation amounts that increase when the boilers during combustion are moved from the combustion position during combustion to the highest combustion position and evaporation amounts that increase when the boilers in steam supply moving processes are moved to the highest combustion positions.

According to the controller of the present invention, the total load following evaporation amount is secured with objects of calculation being evaporation amounts that increase when respective boilers that are supplying steam at combustion positions that are lower than the highest combustion positions are moved from the combustion positions during combustion to the highest combustion positions as well as evaporation amounts that increase when boilers during steam supply moving processes are moved to the highest combustion positions so that even if a boiler during steam supply moves to a higher combustion position, any boiler is moved to the steam supply moving process and the load following evaporation amount increases by an amount corresponding to the evaporation amount that increased when the boiler has reached the highest combustion position (that is subject to operation) so that it is possible to easily and effectively improve the load following capabilities of the group of boilers.

By performing calculation with objects of calculation being evaporation amounts that increase when boilers in steam supply moving processes have moved to highest combustion positions, it is possible to reduce the number of boilers that are moved to the steam supply moving processes so as to suppress excess energy consumption.

One feature of the above-described one aspect of the invention is the controller, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

One feature of the above-described another aspect of the invention is the controller, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

One feature of the above-described yet another aspect of the invention, is the controller, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

According to the controller as described in the above features of the one aspect, another aspect and yet another aspect of the invention, in securing the total load following evaporation amount of the group of boilers, combinations of combustion positions (selected boilers and combustion positions) that can be arranged by sequentially moving from combinations of currently combusting combustion positions are extracted so as to select a combination of combustion positions with which the total evaporation amount becomes minimum from among these, so that it is accordingly possible to suppress excess energy consumption while securing load following capabilities of the group of boilers.

With regard to the one feature of the above-described one aspect of the invention relating to the controller, in setting a combination with which the total evaporation amount becomes minimum, the program may be arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

With regard to the one feature of the above-described another aspect of the invention relating to the controller, in setting a combination with which the total evaporation amount becomes minimum, the program may be arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

With regard to the one feature of the above-described yet another aspect of the invention relating to the controller, in setting a combination with which the total evaporation amount becomes minimum, the program may be arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

According to the controller as described in the above features of the one aspect, another aspect and yet another aspect of the invention, in selecting a combination of combustion positions with which the total evaporation amount becomes minimum while securing the total load following evaporation amount of the group of boilers, combinations of combustion positions to be objects are extracted on the basis of the setup load following evaporation amount or the setup range for the load following evaporation amount from among those to which it is possible to sequentially move the combustion positions from combinations of combustion positions that are currently combusting, and a combination of combustion positions with which the total evaporation amount becomes minimum is selected from among the extracted combinations of combustion positions so that it is possible to easily and effectively select a combination with which the total evaporation amount becomes minimum while securing the total load following evaporation amount.

An Alternative aspect of the invention is the controller in the above one embodiment or the above another embodiment, wherein, in setting high efficiency combustion positions for the respective boilers and calculating the total evaporation amount and the total load following evaporation amount, the program is arranged to perform calculation wherein from among boilers that are objects of calculations, boilers that are at combustion positions lower than the high efficiency combustion positions are given priority over boilers that have reached the high efficiency combustion positions.

According to the controller of the present invention, in calculating the total evaporation amount and the total load following evaporation amount, boilers that are at combustion positions lower than the high efficiency combustion positions are given priority over boilers that have reached the high efficiency combustion positions so that boilers that have reached the high efficiency combustion positions are operated at the high efficiency combustion positions until the remaining boilers that are subject to operation have reached the high efficiency combustion positions. As a result, operations of the group of boilers at high efficiency combustion positions are increased so that it is possible to improve the energy efficiency of the group of boilers.

Another alternative aspect of the invention is the controller in the above one embodiment or the above another embodiment, wherein the program is arranged to set a setup maximum evaporation amount that the group of boilers should be able to output to correspond to the required load and to set the boilers that are subject to operation and combustion positions such that the maximum evaporation amount that can be output by the group of boilers secures the setup maximum evaporation amount.

According to the controller of the present invention, the boilers that are subject to operation and their combustion positions are set such that the maximum evaporation amount that can be output by the group of boilers secures the setup maximum evaporation amount so that it is possible to suppress shortage in the evaporation amount with respect the required load and to accordingly suppress excess energy consumption.

According to the controller and the boiler system of the present invention, it is possible to easily secure load following capabilities when operating conditions fluctuate in a group of boilers having boilers with a plurality of staged combustion positions.

BRIEF DESCRIPTION OF THE DRAWINGS

FIG. 3 shows a view showing one example of a database according to the first embodiment;

FIG. 8 shows a view showing one example of a database according to the second embodiment;

FIG. 11 shows a view for explaining one example of combinations of combustion positions made by the program according to the second embodiment;

FIG. 15 shows a view for explaining actions of the group of boilers according to the third embodiment.

DETAILED DESCRIPTION OF THE INVENTION

The first embodiment of the present invention will now be explained with reference to FIG. 1 to FIG. 5.

Figure 1:
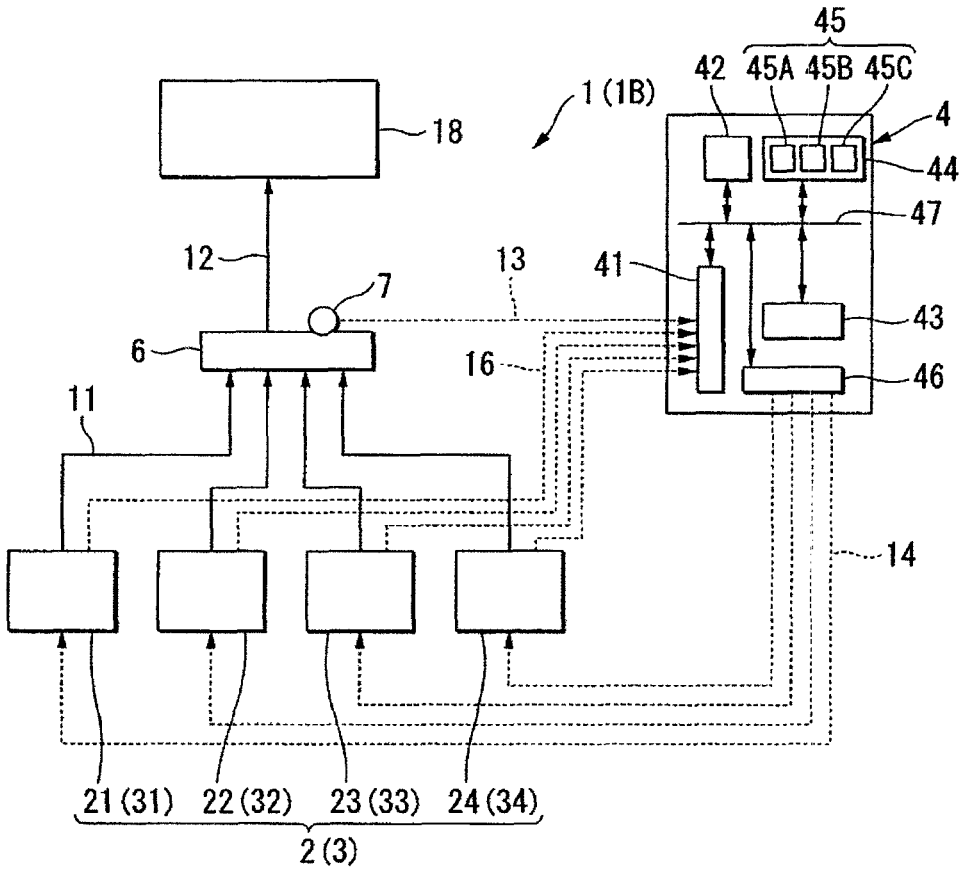
FIG. 1 shows a view schematically showing a boiler system according to a first and third embodiment of the present invention.

FIG. 1 is a view showing a boiler system according to the first embodiment, wherein reference number 1 denotes a boiler system.

As shown in FIG. 1, the boiler system 1 includes a group of boilers 2 having, for instance, four boilers, a controlling portion (controller) 4, a steam header 6, and a pressure sensor 7 for detecting steam pressure within the steam header 6 (a physical amount corresponding to the evaporation amount), wherein steam generated by the group of boilers 2 is supplied to a steam utilizing equipment 18.

The required load in this embodiment is substituted by the steam pressure (physical amount) within the steam header 6 that is detected by the pressure sensor 7, and the required evaporation amount that corresponds to the consumed evaporation amount of the steam utilizing equipment 18 is calculated based on this pressure.

The group of boilers 2 includes, for instance, a first boiler 21, a second boiler 22, a third boiler 23 and a fourth boiler 24, and the respective boilers 21 to 24 include three-positions boilers that can be controlled to assume three staged combustion conditions including a combustion standstill condition (combustion standstill position), a low combustion condition (first combustion position) and a high combustion condition (second combustion position), wherein the first combustion position is defined to be a high efficiency combustion position at which the boiler can perform high efficiency combustion.

The steam header 6 is connected to the first to fourth boilers 21 to 24 by means of steam tubings 11 and to the steam utilizing equipment 18 by means of a steam tubing 12 so as to collect steam generated by the group of boilers 2, to adjust pressure differences and pressure fluctuations among respective boilers and to supply steam to the steam utilizing equipment 18.

A priority order of the respective boilers 21 to 24 is preliminarily set, wherein the respective boilers 21 to 24 assume low combustion conditions according to this priority order, and after all of the boilers that are subject to operation have reached the low combustion condition (high efficiency combustion position), the boilers sequentially move to the high combustion conditions in accordance with the priority order. In this respect, the priority order and setting of reserve cans are defined to be changeable either automatically or manually.

Figure 2:
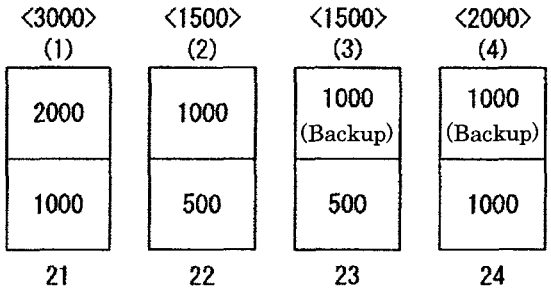
FIG. 2 shows a view for explaining a schematic arrangement of a group of boilers according to the first embodiment.

FIG. 2 is a view for conceptually showing the respective boilers 21 to 24 constituting the group of boilers 2, wherein the respective frames represent the boilers 21 to 24, and frames partitioning the respective boilers 21 to 24 represent combustion positions of the respective boilers 21 to 24.

Numbers within frames that represent combustion positions indicate differential evaporation amounts of the respective combustion positions, numbers within ( ) upward of the respective frames indicate priority orders when increasing the evaporation amount of the group of boilers 2, numbers within < > indicate rated evaporation amounts, and descriptions (backup) indicate that these combustion positions are reserve cans (combustion positions that are not subject to operation).

The first boiler 21 is defined to have a first differential evaporation amount of 1000 (kg/h), a second differential evaporation amount of 2000 (kg/h), and a rated evaporation amount of 3000 (kg/h).

The second boiler 22 is defined to have a first differential evaporation amount of 500 (kg/h), a second differential evaporation amount of 1000 (kg/h), and a rated evaporation amount of 1500 (kg/h).

The third boiler 23 is defined to have a first differential evaporation amount of 500 (kg/h), a second differential evaporation amount of 1000 (kg/h), and a rated evaporation amount of 1500 (kg/h).

The fourth boiler 24 is defined to have a first differential evaporation amount of 1000 (kg/h), a second differential evaporation amount of 1000 (kg/h), and a rated evaporation amount of 2000 (kg/h).

In this embodiment, the group of boilers 2 is arranged such that the second combustion position of the third boiler 23 and the second combustion position of the fourth boiler 24 are set as reserve cans at the time of starting operation.

The boilers 21 to 24 can improve the load following capabilities by securing a total load following evaporation amount upon moving to the first combustion positions in a short period of time when the boilers are in steam supply moving processes.

In this embodiment, a steam supply moving process denotes a time during which the respective boilers 21 to 24 have reached the first combustion positions which are the lowest combustion position from the combustion standstill positions and the boilers start steam supply, and the steam supply moving processes can be classified into the following first to fifth conditions (wherein intermediate conditions between the first to fifth conditions are deemed to be included in any of these conditions).

(1) First condition: a condition at a low combustion position wherein pressure is maintained though no steam supply is performed.

(2) Second condition: a continuous pilot combustion condition after cancelling low combustion wherein pressure is maintained though no steam supply is performed.

(3) Third condition: a condition which is a standby condition upon cancelling the low combustion condition wherein pressure is maintained though no steam supply is performed.

(4) Fourth condition: a condition shifted from the combustion standstill position to the low combustion position wherein water is heated but no pressure is maintained (pressure-less condition).

(5) Fifth condition: a continuous pilot combustion condition wherein no pressure is maintained (pressure-less condition).

While 1) and 2) are suitable for performing steam supply in a short period of time, it is also possible to apply 3) to 5).

The controlling portion 4 includes an input portion 41, a memory 42, an arithmetic portion 43, a hard disk 44, an output portion 46 and communication lines 47, wherein the input portion 41, the memory 42, the arithmetic portion 43, the hard disk 44 and the output portion 46 are mutually connected by the communication lines 47 such that they can transmit data and others, and the hard disk 44 stores therein a database 45.

The input portion 41 includes a data entry device such as a keyboard (not shown) such that settings and others can be output to the arithmetic portion 43, and it is further connected to the pressure sensor 7 and the boilers 21 to 24 via signal line 13 and signal lines 16 so that pressure signals input from the pressure sensor 7 and signals input from the boilers 21 to 24 (for instance, information related to combustion positions and others) can be output to the arithmetic portion 43. The setup load following evaporation amount JT, that is, the setup maximum evaporation amount can be preliminarily set.

The output portion 46 is connected to the boilers 21 to 24 via signal lines 14, and control signals output from the arithmetic portion 43 are output to the respective boilers 21 to 24.

The arithmetic portion 43 reads and executes programs stored in a memory medium of the memory 42 (for instance, a ROM), performs calculation of evaporation amounts corresponding to required loads and selection of boilers to be combusted in the group of boilers 2 and combinations of combustion positions thereof, and outputs control signals to the boilers 21 to 24 via the output portion 46 based on these results.

The database 45 includes a first database 45A, a second database 45B, and a third database 45C.

In the first database 45A, numerical data for indicating a relationship between pressure signal (mV) and pressure P (t) (Pa) are stored in form of a data table (not shown), and the arithmetic portion 43 refers these data to the pressure signals (mV) from the pressure sensor 7 for calculating the pressure P (t) within the steam header 6.

In the second database 45B, numerical data for indicating a relationship between a target pressure PT for the steam header 6 in the group of boilers 2 and an evaporation amount for creating the target pressure PT are stored in form of a data table, and the arithmetic portion 43 refers the pressure P (t) within the steam header 6 as input from the input portion 41 to the target pressure PT to obtain the required evaporation amount JN.

In the third database 45C, numerical data indicating differential evaporation amounts Ji(j) of respective combustion positions of the boilers 21 to 24 and total load following evaporation amounts GiA(j), GiB(j), GiC(j) where the boilers 21 to 24 are in steam supply moving processes and at respective combustion positions are stored in form of a data table as shown, for instance, in FIG. 3.

Here, i (=21, 22, 23, 24) in FIG. 3 indicates a code for specifying a boiler, and j (=0, 1, 2) a code for specifying a combustion position. Further, j=0 indicates a pressure keeping condition in the steam supply moving process (wherein either one of the first to third conditions is set), and Gi(0) a total load following evaporation amount when a pressure keeping condition is present in the steam supply moving process.

The total load following evaporation amount GiA(j), the total load following evaporation amount GiB(j) and the total load following evaporation amount GiC(j) as shown in FIG. 3 can be calculated as follows.

Total load following evaporation amount GiA(j): objects of calculation are evaporation amounts that increase when combustion positions during combustion are moved to the highest combustion positions.

Total load following evaporation amount GiB(j): objects of calculation are evaporation amounts that increase when combustion positions during combustion are moved to the highest combustion positions and evaporation amounts that increase when boilers in steam supply moving processes are moved to the lowest combustion positions.

Total load following evaporation amount GiC(j): objects of calculation are evaporation amounts that increase when combustion positions during combustion are moved to the highest combustion positions and evaporation amounts that increase when boilers in steam supply moving processes are moved to the highest combustion positions.

In this embodiment, the total load following evaporation amount JG is calculated by summing up the total load following evaporation amounts GiC(j) corresponding to the combustion positions or the steam supply moving processes of the boilers 21 to 24.

The arithmetic portion 43 selects (calculates) boilers and combustion positions to secure the required evaporation amounts JN, total evaporation amounts JR satisfying the setup load following evaporation amounts JT and the total load following evaporation amounts JG by referring to the third database 45C.

When changes in the priority order and changes in settings for the reserve cans are made, the arithmetic portion 43 further selects (sets) boilers that are subject to operation, combinations of combustion positions and priority orders such that the maximum evaporation amount that the group of boilers 2 can output secures a setup maximum evaporation amount that the boilers should be able to output (equal to or more than the setup maximum evaporation amount) to correspond to the required load.

In this respect, the maximum evaporation amount for securing the setup maximum evaporation amount is suitably set to be minimum within the range satisfying maximum evaporation amount≥setup maximum evaporation amount in view of saving energy.

However, while the number of combustion positions of the boilers 21 to 24 of the group of boilers 2 is identical in the first embodiment, the differential evaporation amounts of the first and second combustion positions differ from each other and include dissimilar boilers so that the first embodiment is arranged in that no changes of reserve cans (combustion positions) are made for setting the maximum evaporation amount to minimum when maximum evaporation amount≥setup maximum evaporation amount is satisfied.

In other words, where maximum evaporation amount≥setup maximum evaporation amount is satisfied, the second combustion positions of boilers of which priority orders are third and fourth are maintained as reserve cans.

Hereinafter, one example of a flow of a program according to the first embodiment will now be explained with reference to FIG. 4.

(1) First, initial values (=0) are set for each of the required evaporation amount JN corresponding to the required load for the group of boilers 2, the total evaporation amount JR obtained by summing up the evaporation amounts of the boilers 21 to 24, and the total load following evaporation amount JG obtained by summing up the load following evaporation amounts of the boilers 21 to 24, and the setup load following evaporation amount JT which the group of boilers 2 is to secure is set (S1).

(2) It is determined whether the group of boilers 2 is operating or not (S2).

Where the group of boilers 2 is operating, the program proceeds to S3 whereas where the group of boilers 2 is out of operation, the program is terminated.

(3) The arithmetic portion 43 calculates the required evaporation amount JN by referring to the first database 45A and the second database 45B for the output signals from the output sensor 7 obtained via the input portion 41 (S3). The calculated required evaporation amount JN is stored in the memory 42.

(4) The arithmetic portion 43 compares the required evaporation amount JN calculated in S3 with the total evaporation amount JR stored in the memory 42 to determine whether total evaporation amount JR<required evaporation amount JN is satisfied or not (S4).

Where total evaporation amount JR<required evaporation amount JN is satisfied, the program proceeds to S5, and where the total evaporation amount JR<required evaporation amount JN is not satisfied, the program proceeds to S12.

(5) The arithmetic portion 43 compares the total load following evaporation amount JG with the setup load following evaporation amount JT stored in the memory 42 to determine whether total load following evaporation amount JG>setup load following evaporation amount JT is satisfied or not (S5).

When total load following evaporation amount JG>setup load following evaporation amount JT is satisfied, the program proceeds to S6 to determine whether it is possible to move the combustion position during combustion to a higher stage in accordance with reductions in the total load following evaporation amount JG in increasing the total evaporation amount JR, and when total load following evaporation amount JG>setup load following evaporation amount JT is not satisfied, the program proceeds to S11.

(6) The arithmetic portion 43 refers to the third database 45C to calculate a provisional total load following evaporation amount JGX when boilers of highest priority among the boilers that can be moved to higher combustion positions are moved to combustion positions higher by one stage (S6).

(7) The arithmetic portion 43 determines whether provisional total load following evaporation amount JGX≥setup load following evaporation amount JT is satisfied or not (S7).

When provisional total load following evaporation amount JGX≥setup load following evaporation amount JT is satisfied, the program proceeds to S8, and when provisional total load following evaporation amount JGX≥setup load following evaporation amount JT is not satisfied, the program proceeds to S11.

(8) The arithmetic portion 43 outputs a signal for moving a boiler of highest priority from among boilers that can be moved to higher combustion positions to a combustion position that is higher by one stage (S8).

(9) The arithmetic portion 43 refers to the third database 45C to calculate the total evaporation amount JR after moving (S9). The calculated total evaporation amount JR is stored in the memory 42. Upon execution of S9, the program proceeds to S10.

(10) The arithmetic portion 43 refers to the third database 45C to calculate the total load following evaporation amount JG (S10). The calculated total load following evaporation amount JG is stored in the memory 42. Upon execution of S10, the program proceeds to S4.

(11) The arithmetic portion 43 outputs a signal for moving a boiler of second priority (boiler of highest priority order from among boilers that are at combustion standstill positions) to the first combustion position (S11). Upon execution of S11, the program proceeds to S9.

(12) The arithmetic portion 43 compares the total load following evaporation amount JG and the setup load following evaporation amount JT stored in the memory 42 and determines whether total load following evaporation amount JG<setup load following evaporation amount JT is satisfied or not (S12).

Where total load following evaporation amount JG<setup load following evaporation amount JT is satisfied, the program proceeds to S13, and where total load following evaporation amount JG<setup load following evaporation amount JT is not satisfied, the program proceeds to S16.

(13) The arithmetic portion 43 outputs a signal for moving a boiler of second priority (boiler of highest priority order from among boilers that are at combustion standstill positions) to the steam supply moving process (S13).

The reason for moving a boiler of second priority to the steam supply moving process is to increase the total load following evaporation amount JG without increasing the total evaporation amount JR since it has been confirmed in S4 that total evaporation amount JR≥required evaporation amount JN is satisfied. However, in case boilers in steam supply moving processes are not objects of calculation of the total load following evaporation amount JG, it is suitable to move the boiler of second priority to the first combustion position.

(14) The arithmetic portion 43 refers to the third database 45C to calculate the total evaporation amount JR after moving (S14). The calculated total evaporation amount JR is stored in the memory 42. Upon execution of S14, the program proceeds to S15.

(15) The arithmetic portion 43 refers to the third database 45C to calculate the total load following evaporation amount JG (S15). The calculated total load following evaporation amount JG is stored in the memory 42. Upon execution of S15, the program proceeds to S12.

(16) The arithmetic portion 43 refers to the third database 45C to calculate a provisional total evaporation amount JRY and a provisional total load following evaporation amount JGY when a boiler of lowest priority that is in a combusting condition is moved to a combustion position that is lower by one stage (or to the combustion standstill position or the steam supply moving process) (S16).

(17) The arithmetic portion 43 compares the provisional total evaporation amount JRY that has been calculated in S16 and the required evaporation amount JN to determine whether provisional total evaporation amount JRY≥required evaporation amount JN is satisfied or not (S17).

Where provisional total evaporation amount JRY≥required evaporation amount JN is satisfied, the program proceeds to S18, and where provisional total evaporation amount JRY≥required evaporation amount JN is not satisfied, the program proceeds to S2.

(18) The arithmetic portion 43 compares the provisional total load following evaporation amount JGY that has been calculated in S16 with the setup load following evaporation amount JT to determine whether provisional total load following evaporation amount JGY≥setup load following evaporation amount JT is satisfied or not (S18).

Where provisional total load following evaporation amount JGY≥setup load following evaporation amount JT is satisfied, the program proceeds to S19, and where provisional total load following evaporation amount JGY≥setup load following evaporation amount JT is not satisfied, the program proceeds to S2.

(19) The arithmetic portion 43 cancels combustion of a boiler of lowest priority from among boilers that are objects of calculation in S16 (S19). Upon execution of S19, the program proceeds to S20.

(20) The arithmetic portion 43 refers to the third database 45C to calculate the total evaporation amount JR after moving a boiler of lowest priority order to a combustion position that is lower by one stage (or to the combustion standstill position or the steam supply moving process) (S20).

Upon calculation of the total evaporation amount JR, the total evaporation amount JR is stored in the memory 42, and the program proceeds to S21.

(21) The arithmetic portion 43 refers to the third database 45C to calculate the total load following evaporation amount JG after moving a boiler of lowest priority order to a combustion position that is lower by one stage (or to the combustion standstill position or the steam supply moving process) (S21).

Upon calculation of the total load following evaporation amount JG, the total load following evaporation JG is stored in the memory 42, and the program proceeds to S2.

The above (2) to (21) are repeatedly executed.

Figure 4:
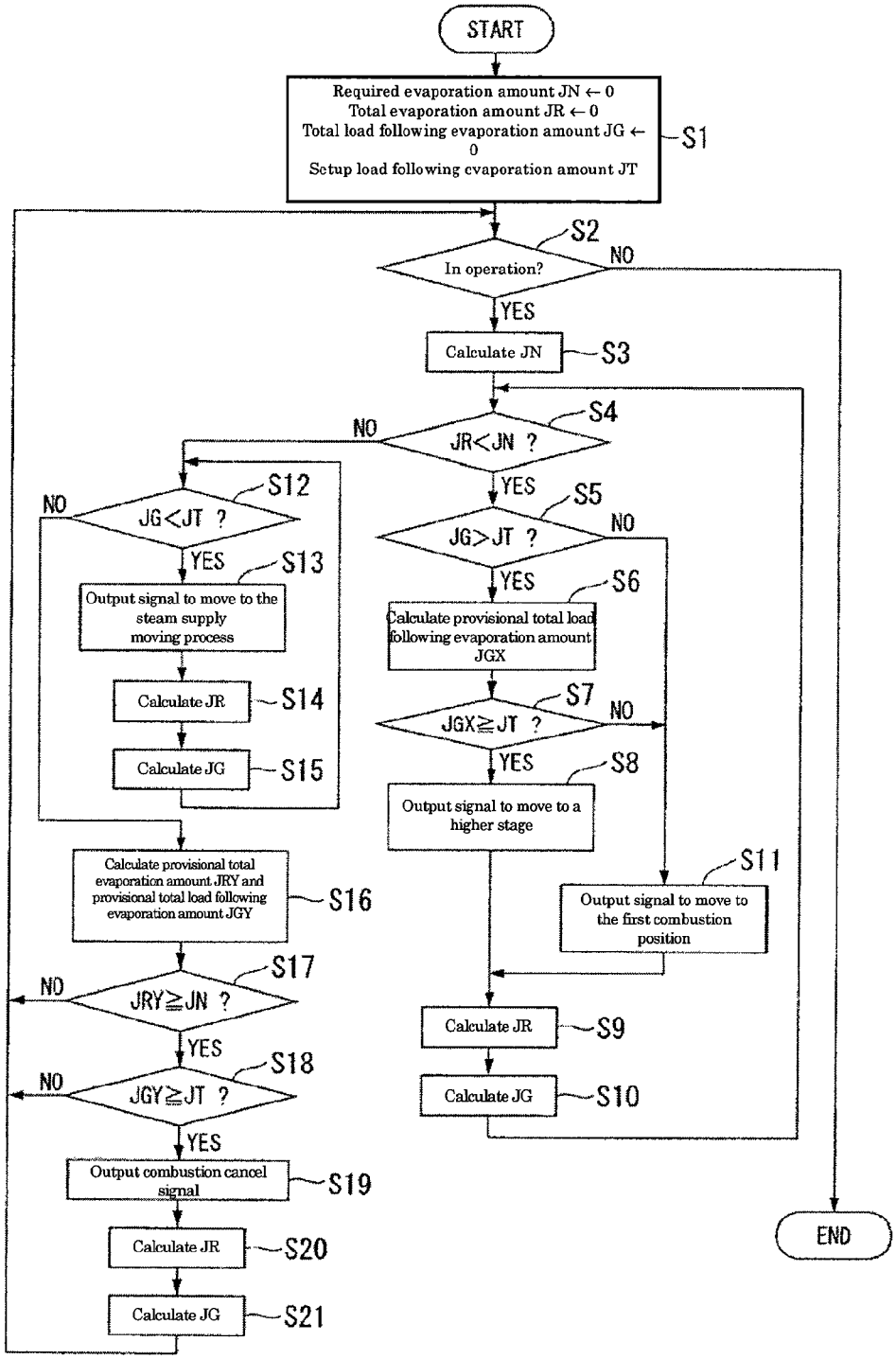
FIG. 4 shows a flowchart for explaining one example of a program according to the first embodiment.

It should be noted that in the flowchart of FIG. 4, a step (not shown) for determining whether there are any higher combustion positions to which the boiler can be moved is provided prior to S6, and where it is determined that there is a higher combustion position to which the boiler can be moved, the program proceeds to S6 whereas where it is determined that there is no higher combustion position to which the boiler can be moved, the program proceeds to S11.

Further, in the flowchart of FIG. 4, a step (not shown) for determining whether there are any boilers which are at combustion positions or in steam supply moving processes and which are movable to the first combustion position is provided prior to S11, and where it is determined that there is such a boiler which is subject to movement, the program proceeds to S11 whereas where it is determined that there is no boiler which is subject to movement, the program proceeds not to S11 but to S8.

Moreover, in the flowchart of FIG. 4, a step (not shown) for determining whether there are any boilers which are movable to the steam supply moving process is provided prior to S13, and where it is determined that there is such a boiler which is movable to the steam supply moving process, the program proceeds to S13 whereas where it is determined that there is no boiler which is subject to movement, the program proceeds not to S13 but to S16.

Still further, in the flowchart of FIG. 4, a step (not shown) for determining whether there are any combustion positions that are subject to combustion cancellation is provided prior to S16, and where it is determined that there is a boiler which is at a combustion position that is object (candidate) of cancellation of combustion, the program proceeds to S16 whereas where it is determined that there is no boiler which is at a combustion positions that is subject to cancellation of combustion, the program proceeds to S2.

Figure 5:
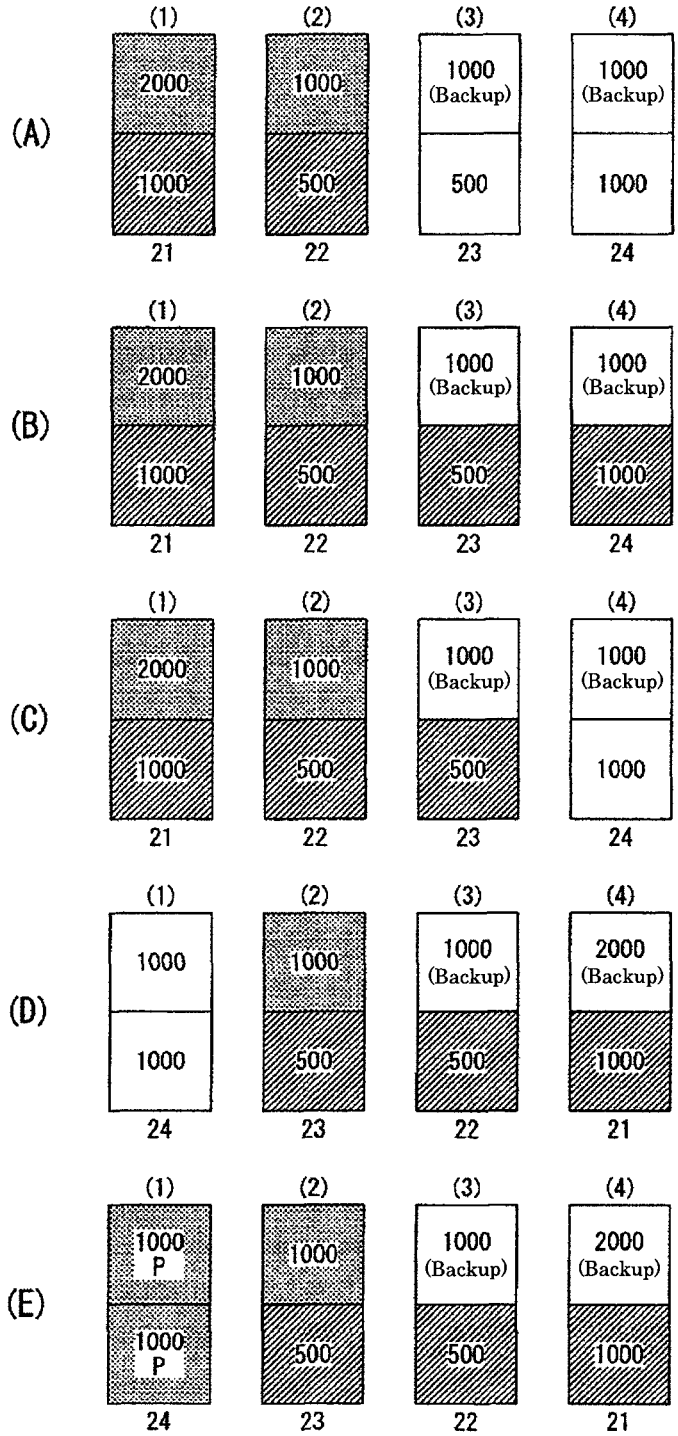
FIG. 5 shows a schematic view for explaining one example of operations of the boiler system according to the first embodiment.

Next, reference is made to FIG. 5 for explaining operations of the boiler system 1.

In FIG. 5, numbers within ( ) upward of the frames that represent the boilers 21 to 24 indicate priority orders, frames within the frames that represent the boilers 21 to 24 indicate combustion positions, and (backup) written into frames that represent the combustion positions indicate reserve cans (combustion positions) that are not subject to operation.

Combustion positions marked with hatchings indicate combustion positions during steam supply which are objects of calculation for the total evaporation amount JR, combustion positions that are only shaded indicate combustion positions which are objects of calculation of the total load following evaporation amount JG, and combustion positions marked with shades and "P" indicate combustion positions that are to be objects of calculation of the total load following evaporation amount JG since the boilers are in steam supply moving processes.

The boiler system 1 is arranged in that boilers and combustion positions are selected in accordance with a priority order in increasing the evaporation amount, and boilers and combustion positions are selected in an order reverse to the priority order in reducing the evaporation amount.

Further, where maximum evaporation amount≥setup maximum evaporation amount as mentioned above is satisfied, the second combustion positions of boilers of third and fourth priority order are maintained as reserve cans.

In this respect, as shown in FIG. 5A, the first combustion position of the first boiler 21 and the first combustion position of the second boiler 22 from among the group of boilers 2 are defined to be combusting. The setup maximum evaporation amount of the group of boilers 2 is defined to be 5000 (kg/h) and the setup load following evaporation amount JT to be 2000 (kg/h).

(1) FIG. 5A is a view showing an example in which the required evaporation amount JN is set to be 1300 (kg/h).

As shown in FIG. 5A, the arithmetic portion 43 outputs combustion signals to the first boiler 21 of priority order (1) and to the second boiler 22 of priority order (2), and the first combustion position of the first boiler 21 and the first combustion position of the second boiler 22 are in combusting conditions.

In FIG. 5A, the group of boilers has a total evaporation amount JR of 1500 (kg/h) and a total load following evaporation amount JG of 3000 (kg/h), and satisfies a required evaporation amount JN of 1300 (kg/h) and a setup load following evaporation amount JT of 2000 (kg/h).

In other words, in a condition in which there are no increases and decreases in the required evaporation amount JN, the arithmetic portion 43 sequentially executes the S2, S3, S4, S12, S16 and S17 in the flowchart shown in FIG. 4, and since the provisional total evaporation amount JRY as calculated in S16 when the second boiler 22 of lowest priority order in a combusting condition is moved to a combustion position lower by one stage is 1000 (kg/h), provisional total evaporation amount JRY≥required evaporation amount JN is not satisfied in S17 so that the program proceeds to S2.

Accordingly, the condition as shown in FIG. 5A is maintained.

Further, since the maximum evaporation amount is 6000 (kg/h), it satisfies the setup maximum evaporation amount of 5000 (kg/h).

(2) Next, FIG. 5B is a view showing a condition in which the required evaporation amount JN is increased to 2800 (kg/h).

When the necessary evaporation amount increases to 2800 (kg/h), the arithmetic portion 43 executes S2, S3 and S4, and since the total evaporation amount JR is 1500 (kg/h), total evaporation amount JR<required evaporation amount (=2800 (kg/h)) is satisfied in S4 so that the program proceeds to S5.

Upon execution of S5, total load following evaporation amount JG (=3000 (kg/h))>setup load following evaporation amount JT (=2000 (kg/h)) is satisfied, and since the first boiler 21 exists as a boiler that can be moved to a higher combustion position (a boiler of highest priority order among boilers that can be moved to higher combustion positions), the program proceeds to S6.

Executing S6 for calculating the provisional total load following evaporation amount JGX when the first boiler 21 of highest priority order among boilers that can be moved to higher combustion positions is moved to a combustion position that is higher by one stage, the value will be 1000 (kg/h).

Next, when the program proceeds to S7 to compare the provisional total load following evaporation amount JGX (=1000 (kg/h)) with the setup load following evaporation amount JT (=2000 (kg/h)), provisional total load following evaporation amount JGX≥setup load following evaporation amount JT (=2000 (kg/h)) is not satisfied. Further, since the third boiler 23 (boiler of highest priority order from among boilers at a combustion standstill position) exists as a boiler that can be moved to the first combustion position, the program proceeds to S11 for executing S11 to move the third boiler 23 to the first combustion position.

The program proceeds to S9 to calculate the total evaporation amount JR (=2000 (kg/h)), to S10 to calculate the total load following evaporation amount JG (=3000 (kg/h)), and to S4 thereafter.

Upon execution of S4, total evaporation amount JR (=2000 (kg/h))<required evaporation amount (=2800 (kg/h)) is satisfied so that the program proceeds to S5, and since the total load following evaporation amount JG is 3000 (kg/h), total load following evaporation amount JG>setup load following evaporation amount JT (=2000 (kg/h)) is satisfied upon executing S5, and since the first boiler 21 (boiler of highest priority order among the boilers that can be moved to higher combustion positions) exists as a boiler that can be moved to a higher combustion position, the program proceeds to S6.

Upon execution of S6 for calculating the provisional total load following evaporation amount JGX when the first boiler 21 of highest priority order among boilers that can be moved to higher combustion positions is moved to a combustion position that is higher by one stage, this value will be 1000 (kg/h), and upon comparing the provisional total load following evaporation amount JGX (=1000 (kg/h)) and the setup load following evaporation amount JT (=2000 (kg/h)) in S7, provisional total load following evaporation amount JGX≥setup load following evaporation amount JT (=2000 (kg/h)) will not be satisfied. Since the fourth boiler 24 (highest priority order) exists that is at the combustion standstill position as a boiler that can be moved to the first combustion position, the program proceeds to S11 for executing S11 to move the fourth boiler 24 to the first combustion position.

Next, S9 and S10 are executed to calculate the total evaporation amount JR (=3000 (kg/h)) and the total load following evaporation amount JG (=3000 (kg/h)) after executing S11, and the program then proceeds to S4.

In FIG. 5B, the total evaporation amount JR (=3000 (kg/h) and the total load following evaporation amount JG (=3000 (kg/h)) of the group of boilers 2 satisfy the required evaporation amount (=2800 (kg/h)) and the setup load following evaporation amount JT (=2000 (kg/h)).

In other words, in a condition in which there are no increases and decreases in the required evaporation amount JN, the arithmetic portion 43 sequentially executes S2, S3, S4 and S12 in the flowchart, and since the first combustion positions of the first to fourth boilers 21 to 24 are combusting as candidates of cancellation of combustion, the program proceeds to S16. The program then sequentially executes S16 and S17 wherein in S16, the provisional total evaporation amount JRY (=2000 (kg/h)) when the fourth boiler 24 of lowest priority order is moved to a combustion position that is lower by one stage and the provisional total load following evaporation amount JGY (=2000 (kg/h)) are calculated, and when the provisional total evaporation amount JRY and the required evaporation amount JN (=2800 (kg/h)) are compared in S17, provisional total evaporation amount JRY≥required evaporation amount JN (=2800 (kg/h)) is not satisfied, and the program proceeds to S2.

Accordingly, the condition as shown in FIG. 5B is maintained.

Further, since the maximum evaporation amount is 6000 (kg/h), the setup maximum evaporation amount of 5000 (kg/h) is satisfied.

(3) FIG. 5C is a view showing a condition in which the required evaporation amount has reduced such that the required evaporation amount JN as calculated in S3 has reduced to, for instance, 1900 (kg/h).

When the required evaporation amount reduces to 1900 (kg/h), the arithmetic portion 43 executes S2, S3 and S4 of the flowchart of FIG. 4, and since total evaporation amount JR (=3000 (kg/h))<required evaporation amount (=1900 (kg/h)) is not satisfied in S4, the program proceeds to S12.

Upon execution of S12, the total load following evaporation amount JG is 3000 (kg/h) so that total load following evaporation amount JG<setup load following evaporation amount JT is not satisfied. Further, since the first combustion position of the fourth boiler 24 (a boiler having a combustion position during combustion which combustion can be cancelled and having the lowest priority order) exists as a combustion position subject to combustion cancellation, the program proceeds to S16. Next, the provisional total evaporation amount JRY (=2000 (kg/h)) and the provisional total load following evaporation amount JGY (=3000 (kg/h)) when the fourth boiler 24 of lowest priority order is moved to a combustion position that is lower by one stage is calculated in S16, and when S17 is executed, provisional total evaporation amount JRY (=2000 (kg/h)) required evaporation amount JN (=1900 (kg/h)) is satisfied, and when S18 is further executed, provisional total load following evaporation amount JGY (=3000 (kg/h))≥setup load following evaporation amount JT (=2000 (kg/h)) is satisfied so that the program proceeds to S19.

Then, S19 is executed to move the fourth boiler 24 to the combustion standstill position and the program proceeds to S20 wherein the total evaporation amount JR (=2000 (kg/h)) is calculated in S20 and then the total load following evaporation amount JG (=3000 (kg/h)) is calculated in S21, whereupon the program proceeds to S2.

The arithmetic portion 43 then executes S2, S3 and S4 of the flowchart. Since the total evaporation amount JR is 2000 (kg/h) and total evaporation amount JR<required evaporation amount (=1900 (kg/h)) is not satisfied in S4, the program proceeds to S12, and since the total load following evaporation amount is 3000 (kg/h), total load following evaporation amount JG<setup load following evaporation amount JT (=2000 (kg/h)) is not satisfied in S12. Since the first combustion position of the third boiler 23 (a boiler having a combustion position during combustion which combustion can be cancelled and having the lowest priority order) exists as a combustion position subject to combustion cancellation, the program proceeds to S16. Next, the provisional total evaporation amount JRY (=1500 (kg/h)) and the provisional total load following evaporation amount JGY (=3000 (kg/h)) when the third boiler 23 during combustion of lowest priority order is moved to the combustion standstill position is calculated in S16, and the program proceeds to S17. Since the provisional total evaporation amount JRY is 1500 (kg/h), provisional total evaporation amount JRY≥required evaporation amount JN (=1900 (kg/h)) is not satisfied in S17, the program proceeds to S2.

In FIG. 5C, in the group of boilers 2, the total evaporation amount JR (=2000 (kg/h) satisfies the required evaporation amount (=1900 (kg/h)), and the total load following evaporation amount JGY (=3000 (kg/h)) satisfies the setup load following evaporation amount JT (=2000 (kg/h)).

In other words, in a condition in which there are no increases and decreases in the required evaporation amount JN, the arithmetic portion 43 executes S2, S3 and S4 in the flowchart, and since total evaporation amount JR (=2000 (kg/h))<required evaporation amount (=1900 (kg/h)) is not satisfied in S4, the program proceeds to S12, and since the total load following evaporation amount is 3000 (kg/h), total load following evaporation amount<setup load following evaporation amount JT (2000 (kg/h)) is not satisfied in S12. Since the first combustion position of the third boiler 23 (a boiler having a combustion position during combustion which combustion can be cancelled and having the lowest priority order) exists as a combustion position subject to combustion cancellation, the program proceeds to S16. Next, since the provisional total evaporation amount JRY is 1500 (kg/h) when the third boiler 23 during combustion of lowest priority order is moved to a combustion position that is lower by one stage (combustion standstill position) in S16, provisional total evaporation amount JRY≥required evaporation amount JN (=1900 (kg/h)) is not satisfied in S17, the program proceeds to S2.

Accordingly, the condition as shown in FIG. 5C is maintained.

Further, since the maximum evaporation amount is 6000 (kg/h), the setup maximum evaporation amount of 5000 (kg/h) is satisfied.

(4) FIG. 15D is a view showing a transition condition after the arithmetic portion 43 has output a priority order changing signal for reversing the priority order of the boilers 21 to 24 and has changed the priority order of the boilers 21 to 24 in the group of boilers 2.

When the priority order is changed, the total evaporation amount JR of the group of boilers 2 is maintained at 2000 (kg/h) while the total load following evaporation amount JG of the group of boilers 2 increases by 1000 (kg/h) corresponding to the second differential evaporation amount of the third boiler 23, and the second combustion positions of the first boiler 21 and the second boiler 22 will become reserve cans so that the total load following evaporation amount reduces by 3000 (kg/h) in total so that the total load following evaporation amount JG of the group of boilers 2 will be 1000 (kg/h).

In this respect, when the priority order of the boilers 21 to 24 of the group of boilers 2 is changed, it is deemed that the total evaporation amount JR and the total load following evaporation amount JG are suitably calculated.

(5) Next, FIG. 5E is a view showing a condition in which the arithmetic portion 43 has set the total load following evaporation amount JG of the group of boilers 2 to be equal to or more than the setup load following evaporation amount JT (=2000 (kg/h)) as a result of the fact that the total load following evaporation amount JG of the group of boilers 2 has become less than the setup load following evaporation amount JT 2000 (kg/h).

In the transition condition of FIG. 5D, the total evaporation amount JR is 2000 (kg/h) and the total load following evaporation amount JG is 1000 (kg/h) so that total evaporation amount JR<required evaporation amount JN (=1900 (kg/h)) in S4 is not satisfied, and upon proceeding to S12, total load following evaporation amount JG<setup load following evaporation amount JT (=2000 (kg/h)) is satisfied in S12. Further, since the fourth boiler 24 (boiler of highest priority order among boilers that can be moved to the steam supply moving process) exists as a boiler that can be moved to the steam supply moving processes, the program proceeds to S13.

Next, S13 is executed to move the fourth boiler 24 to the steam supply moving process.

After executing S13, the arithmetic portion executes S14 and S15 to calculate the total evaporation amount JR (=2000 (kg/h)) and the total load following evaporation amount JG (=3000 (kg/h)), and after executing S15, the program proceeds to S12.

Upon execution of S12, the total load following evaporation amount JG is 3000 (kg/h), and total load following evaporation amount JG<setup load following evaporation amount JT (=2000 (kg/h)) is not satisfied. Further, since the first combustion position of the first boiler 21 (a boiler having a combustion position during combustion which combustion can be cancelled and having the lowest priority order) exists as a combustion position subject to cancellation of combustion, the program proceeds to S16. Next, since the provisional total evaporation amount JRY when the third boiler 23 during combustion which priority order is lowest is moved to a combustion position lower by one stage (combustion standstill position) is 1000 (kg/h), provisional total evaporation amount JRY≥required evaporation amount JN (=1900 (kg/h)) is not satisfied in S17, and the program proceeds to S2.

In this condition, the total evaporation amount JR is 2000 (kg/h) and the total load following evaporation amount JG is 3000 (kg/h) so that the required evaporation amount JN (=1900 (kg/h)) and the setup load following evaporation amount JT (=2000 (kg/h)) are satisfied.

As a result, S2, S4, S12, S16 and S17 are repeated until the required evaporation amount JN increases to exceed the evaporation amount JR, until the required evaporation amount JN reduces to a level at which any of the boilers can be moved to a lower combustion position or the combustion standstill position or until changes of the boilers to be combusted and combustion positions become necessary accompanying the change in priority order of the group of boilers 2.

Accordingly, the condition shown in FIG. 5E is maintained.

Since the maximum evaporation amount is 5000 (kg/h), the setup maximum evaporation amount of 5000 (kg/h) is satisfied.

According to the boiler system 1 and the controller 4 of the present invention, the load following capabilities of the group of boilers 2 can be easily secured even if operating conditions of the boilers constituting the group of boilers 2 are changed.

According to the boiler system 1, since the total load following evaporation amount JG is calculated by summing up the evaporation amounts that increase when the boilers 21 to 24 steam supplying at the first combustion positions (combustion positions lower than the second combustion positions which are highest) are moved to the second combustion positions (highest combustion positions) and the evaporation amounts that increase when the boilers 21 to 24 in steam supply moving processes are moved to the second combustion positions, it is possible to easily secure the total load following evaporation amount JG even if the boilers during steam supply are moved to higher combustion positions.

Further, by defining evaporation amounts that increase when boilers during steam supply moving processes are moved to the second combustion positions as objects of calculation, it is possible to reduce the number of boilers that are moved to the steam supply moving processes and to suppress excess energy consumption.

According to the boiler system 1, an evaporation amount that can be output by the group of boilers 2 is set as the setup maximum evaporation amount, and the boilers subject to operation and their combustion positions are set to secure this setup maximum evaporation amount so that it is possible to suppress excess energy consumption while securing the maximum evaporation amount that corresponds to the required load.

Next, the second embodiment of the present invention will be explained with reference to FIG. 6 to FIG. 12.

Figure 6:
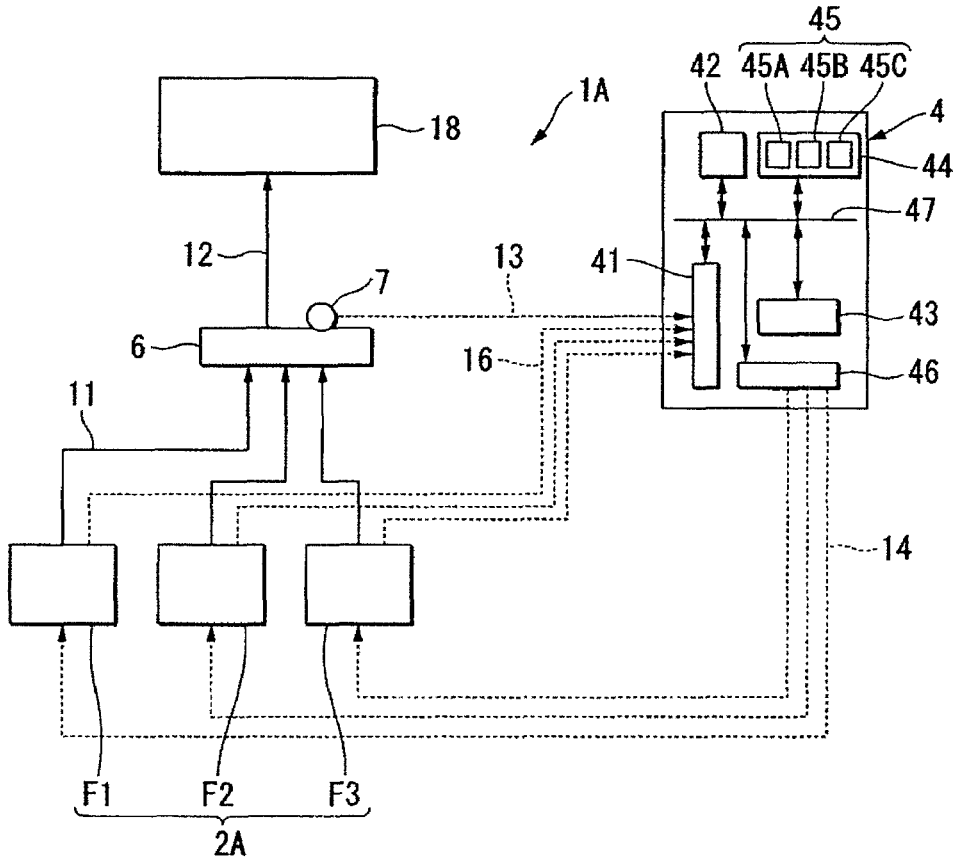
FIG. 6 shows a view showing an outline of a boiler system according to a second embodiment.

FIG. 6 is a view showing a boiler system 1A according to the second embodiment, wherein the second embodiment differs from the first embodiment in that the boiler system 1A includes, in addition to the group of boilers 2 having four boilers, namely the first to fourth boilers 21 to 24, a group of boilers 2A having three boilers.

Further, while the group of boilers 2 is controlled in accordance with a preliminarily set priority order, the group of boilers 2A is arranged such that the boilers and combustion positions (combustion standstill positions, steam supply moving processes) are selected corresponding to the total evaporation amount JR and the total load following evaporation amount JG. The remaining arrangements are identical to those of the first embodiment so that the same reference numerals are marked and explanations are omitted.

As shown in FIG. 6, the boiler system 1A includes, for instance, a first boiler F1, a second boiler F2 and a third boiler F3, wherein the first boiler F1, the second boiler F2, and the third boiler F3 of the present embodiment are arranged to have different combustion positions and differential evaporation amounts.

Figure 7:
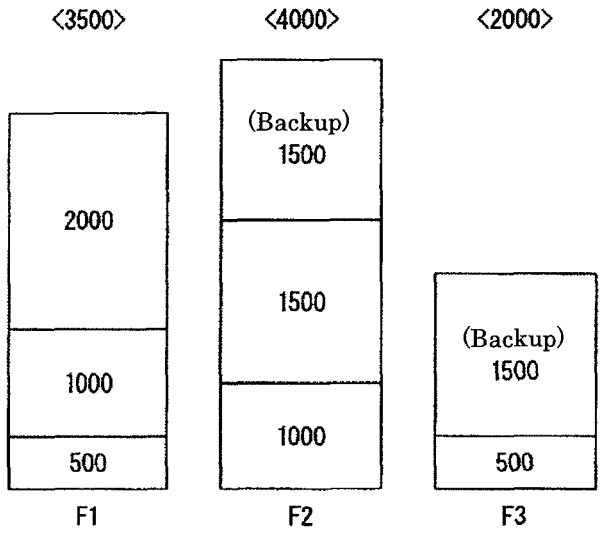
FIG. 7 shows a view for explaining a schematic arrangement of a group of boilers according to the second embodiment.

FIG. 7 is a view for conceptually showing the first boiler F1, the second boiler F2, and the third boiler F3 constituting the group of boilers 2A, wherein the respective frames indicate the first boiler F1, the second boiler F2, and the third boiler F3 whereas the frames partitioning the first boiler F1, the second boiler F2, and the third boiler F3 indicate respective combustion positions.

Numbers within the respective frames that represent combustion positions indicate differential evaporation amounts of the respective combustion positions, numbers within < > indicate rated evaporation amounts, and descriptions (backup) indicate that these combustion positions are reserve cans (combustion positions that are not subject to operation).

The first boiler F1 is defined to be a four-positions boiler having a first differential evaporation amount of 500 (kg/h), a second differential evaporation amount of 1000 (kg/h), and a third differential evaporation amount of 2000 (kg/h), and has a rated evaporation amount of 3500 (kg/h).

The second boiler F2 is defined to be a four-positions boiler having a first differential evaporation amount of 1000 (kg/h), a second differential evaporation amount of 1500 (kg/h), and a third differential evaporation amount of 1500 (kg/h), and has a rated evaporation amount of 4000 (kg/h).

The third boiler F3 is defined to have a first differential evaporation amount of 500 (kg/h), a second differential evaporation amount of 1500 (kg/h) and a rated evaporation amount of 2000 (kg/h).

In the second embodiment, the group of boilers 2A is arranged such that at the time of starting operation, the second combustion position of the second boiler F2 and the second combustion position of the third boiler F3 are set as reserve cans.

The first boiler F1, the second boiler F2, and the third boiler F3 can improve the load following capabilities by securing a total load following evaporation amount upon moving to the first combustion positions in a short period of time when the boilers are in steam supply moving processes.

In this embodiment, a steam supply moving process denotes a period of time during which the first boiler F1, the second boiler F2, and the third boiler F3 have reached the first combustion positions from the combustion standstill positions until the boilers start steam supply, and the steam supply moving processes are identical to those of the first embodiment.

The database 45 includes a first database 45A, a second database 45B and a third database 45C, and the first database 45A and the second database 45B are deemed to be identical to those of the first embodiment.

In the third database 45C, numerical data indicating differential evaporation amounts Ji(j) of respective combustion positions of the first boiler F1, the second boiler F2, and the third boiler F3 and total load following evaporation amounts GiA(j), GiB(j), GiC(j) where the first boiler F1, the second boiler F2, and the third boiler F3 are in steam supply moving processes or at respective combustion positions are stored in form of a data table as shown, for instance, in FIG. 8.

Here, i (=F1, F2, F3) in FIG. 8 indicates a code for specifying a boiler, and j (=0, 1, 2, 3) a code for specifying a combustion position. Further, j=0 indicates a pressure keeping condition in the steam supply moving process (wherein either one of the first to third conditions is set), and Gi(0) means a total load following evaporation amount when a pressure keeping condition is present in the steam supply moving process.

The total load following evaporation amount GiA(j), the total load following evaporation amount GiB(j) and the total load following evaporation amount GiC(j) are identical to those of the first embodiment, and the total load following evaporation amount JG is calculated in the second embodiment by summing, for instance, the total load following evaporation amounts GiC(j).

The arithmetic portion 43 selects (calculates) boilers and combustion positions to reduce the total evaporation amount JR and the total load following evaporation amount JG for securing the required evaporation amount JN, total evaporation amount JR satisfying the setup load following evaporation amount JT and the total load following evaporation amount JG and also for suppressing generation of excess total evaporation amount JR and total load following evaporation amount JG by referring to the third database 45C.

In changing settings for reserve cans, the arithmetic portion 43 is further arranged to select boilers and combustion positions which are to be reserve cans such that the maximum evaporation amount of the group of boilers 2A becomes equal to or more than the setup maximum evaporation amount.

An outline of the program according to the second embodiment will now be explained with reference to FIG. 9.

Figure 9:
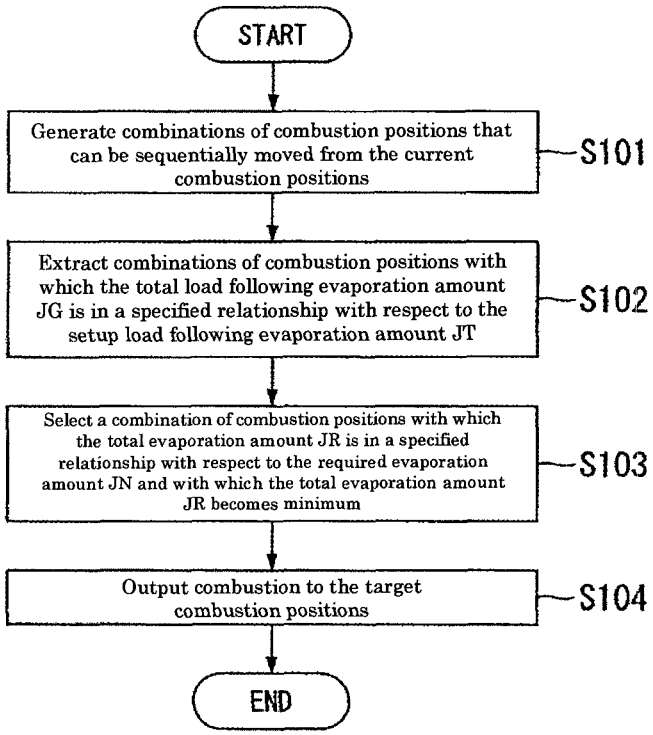
FIG. 9 shows a block diagram for explaining one example of a program according to the second embodiment.

The program according to the second embodiment is provided with the following four functions as shown in the block diagram of FIG. 9.

(1) Combinations of combustion positions to which can be sequentially moved from the current combustion positions during combustion are first generated (S101).

(2) Next, combinations of combustion positions at which the total load following evaporation amount JG has a specified relationship with respect to the setup load following evaporation amount JT are extracted (S102).

A specified relationship of the total load following evaporation amount JG with respect to the setup load following evaporation amount JT might be that the total load following evaporation amount JG is equal to or more than the setup load following evaporation amount JT or within a specified setup range, and in the second embodiment, it means that the total load following evaporation amount JG is equal to or more than the setup load following evaporation amount JT.

(3) Combinations of combustion positions at which total evaporation amount JR≥required evaporation amount JN is satisfied and at which the total evaporation amount JR becomes minimum are selected (S103).

(4) From among the selected combinations of combustion positions, combustion start signals are sequentially output to combustion positions that are currently not combusting (S104).

Figure 10:
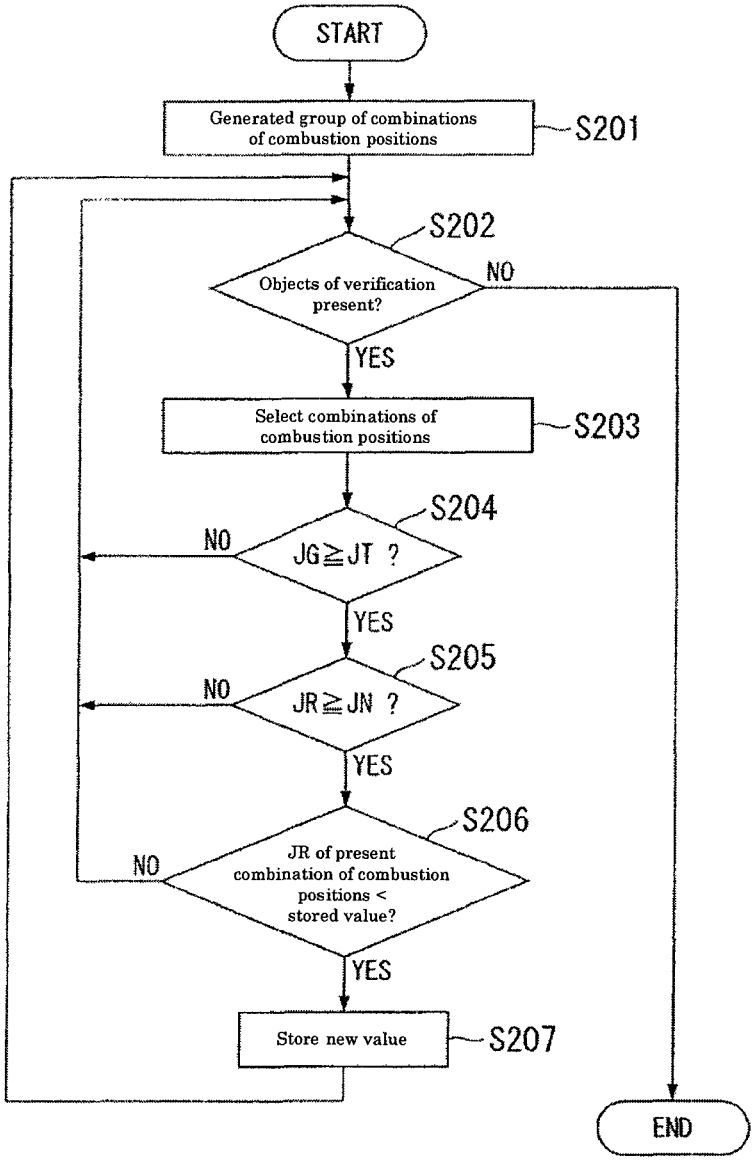
FIG. 10 shows a flowchart for explaining one example of a program according to the second embodiment.

Hereinafter, reference will be made to FIG. 10 for explaining one example of a flow of the program according to the second embodiment. FIG. 10 is a view showing an outline of a flowchart according to the block diagram of FIG. 9.

(1) First, a group of combinations of combustion positions that can be sequentially moved and combined from the current combustion positions of the group of boilers 2A is generated (S201).

(2) It is determined whether there are any groups of combinations of combustion positions that are subject to verification (S202).

When there are any groups of combinations of combustion positions that are subject to verification, the program proceeds to S203, and when there are no groups of combinations of combustion positions that are subject to verification, the program is terminated.

(3) The arithmetic portion 43 suitably selects combinations of combustion positions from among the group of combinations of combustion positions that are subject to verification (S203).

(4) The arithmetic portion 43 compares the total load following evaporation amount JG and the setup load following evaporation amount JT based on the combinations of combustion positions that have been selected in S203 and determines whether total load following evaporation amount JG≥setup load following evaporation amount JT is satisfied or not (S204). Where total load following evaporation amount JG≥setup load following evaporation amount JT is satisfied, the program proceeds to S205 whereas where total load following evaporation amount JG≥setup load following evaporation amount JT is not satisfied, the program proceeds to S202 and abandons the verified combinations of combustion positions.

(5) The arithmetic portion 43 compares the total evaporation amount JR of the combinations of combustion positions that have been verified in S204 and the required evaporation amount JN and determines whether total evaporation amount JR≥required evaporation amount JN is satisfied or not (S205). Where total evaporation amount JR≥required evaporation amount JN is satisfied, these combinations of combustion positions are stored in the memory 42 and the program proceeds to S206, and where the total load following evaporation amount JG≥setup load following evaporation amount JT is not satisfied, the program proceeds to S202 and the verified combinations of combustion positions are abandoned.

(6) The arithmetic portion 43 compares combinations of combustion positions that have satisfied total evaporation amount JR≥required evaporation amount JN in S205 with the total evaporation amount JR of combinations of combustion positions already stored in the memory 42 to determine whether the total evaporation amount JR of the present combinations of combustion positions<total evaporation amount JR of the stored combinations of combustion positions is satisfied or not (S206).

Where total evaporation amount JR of the present combinations of combustion positions<total evaporation amount JR of the stored combinations of combustion positions is satisfied, the program proceeds to S207, and when total evaporation amount JR of the present combinations of combustion positions<total evaporation amount JR of the stored combinations of combustion positions is not satisfied, the program proceeds to S202 and the present combinations of combustion positions are abandoned.

(7) The arithmetic portion 43 stores the present combinations of combustion positions in the memory 42 and the already stored combinations of combustion positions are replaced thereby (S207).

The above (2) to (7) are repeatedly executed.

Operations of the boiler system 1A will now be explained with reference to FIGS. 11 and 12.

FIG. 11 is a chart showing types (No.) of combinations of combustion positions that can be arranged by sequentially moving from combustion conditions of the boilers in FIG. 12A, and represents conditions of respective combustion positions of the first boiler F1, the second boiler F2 and the third boiler F3 of the combinations of combustion positions.

Combustion positions marked as "combusting" indicate already combusting positions in FIG. 12A, the descriptions "reserve cans" indicate that these are not subject to operation, and those marked with ○ indicate that they are newly combusted for securing the total evaporation amount JR and the total load following evaporation amount JG.

Figure 12:
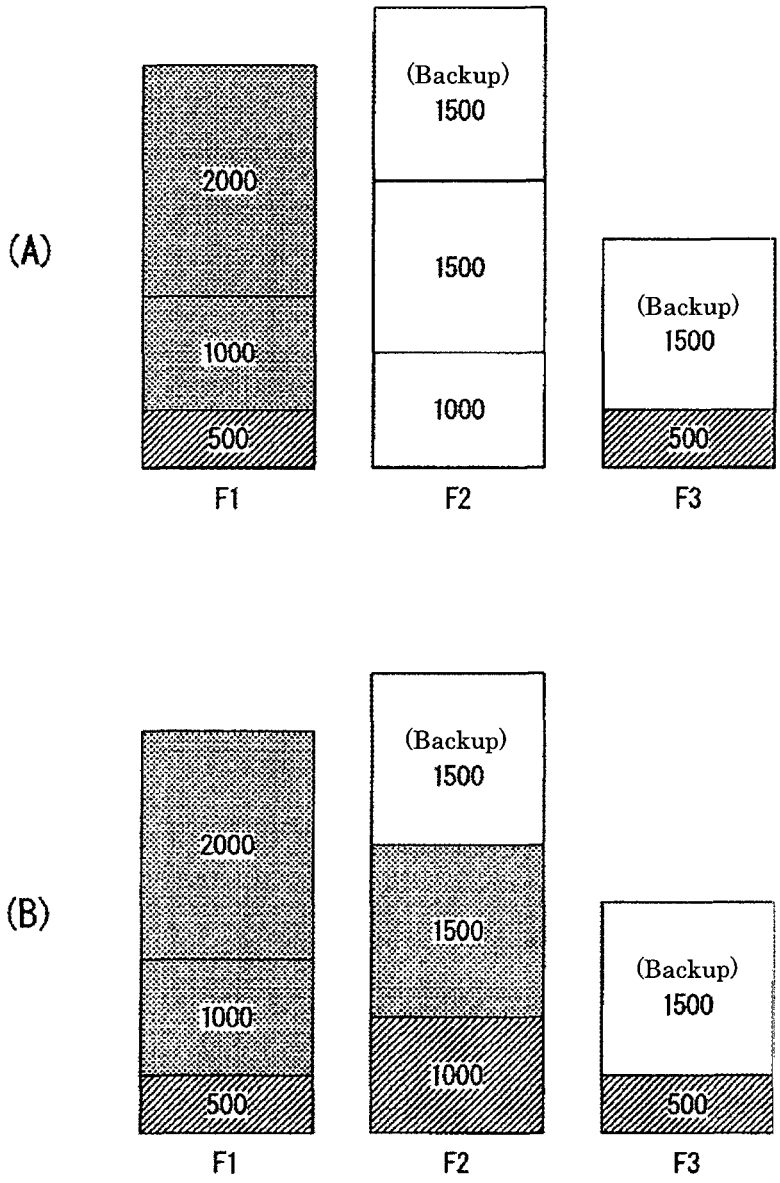
FIG. 12 shows a schematic view for explaining one example of operations of the boiler system according to the second embodiment.

In FIG. 12, frames within the frames that represent the first boiler F1, the second boiler F2 and the third boiler F3 indicate combustion positions, and descriptions (backup) recited within frames representing the combustion positions indicate reserve cans (combustion positions) that are not subject to operation.

Combustion positions marked with hatchings indicate combustion positions during steam supply which are objects of calculation for the total evaporation amount JR, combustion positions that are only shaded indicate combustion positions which are objects of calculation for the total load following evaporation amount JG.

In this respect, while the steam supply moving process is not recited in FIG. 12, it goes without saying that boilers are movable to the steam supply moving process when increasing the total load following evaporation amount JG.

In increasing the evaporation amount, the boiler system 1A secures a total evaporation amount JR and a total load following evaporation amount JG satisfying the required evaporation amount JN and the setup load following evaporation amount JT, and in reducing the evaporation amount, it makes similar decisions for selecting combustion positions during combustion that are to be cancelled.

As shown in FIG. 12A, it is deemed that in the group of boilers 2A, the first combustion position of the first boiler F1 and the first combustion position of the third boiler F3 are already in combusting conditions.

It is deemed that the required evaporation amount JN of the group of boilers 2A has increased to 1000 (kg/h) in FIG. 12A, that the required evaporation amount JN of the group of boilers 2A has increased to 2000 (kg/h) in FIG. 12B and that the setup load following evaporation amount JT is set to 3000 (kg/h).

It should be noted that the setup maximum evaporation amount is omitted for simplification purposes.

(1) Combinations of combustion positions that can be sequentially moved from the currently combusting combustion positions are first generated (S101).

By executing S101,

1) Combination of combustion positions:

F1(1)+F3(1)+F1(2)

In this combination of combustion positions, combustion of F1(2) is newly started, wherein total evaporation amount JR=2000 (kg/h)

total load following evaporation amount JG=2000 (kg/h).

Similarly,

2) Combination of combustion positions:

F1(1)+F3(1)+F2(1)

In this combination of combustion positions, combustion of F2(1) is newly started, wherein total evaporation amount JR=2000 (kg/h)

total load following evaporation amount JG=4500 (kg/h).

3) Combination of combustion positions:

F1(1)+F3(1)+F1(2)+F2(1)

In this combination of combustion positions, combustion of F1(2)+F2(1) is newly started, wherein total evaporation amount JR=3000 (kg/h)
total load following evaporation amount JG=3500 (kg/h).
4) Combination of combustion positions:

F1(1)+F3(1)+F1(2)+F1(3)

In this combination of combustion positions, combustion of F1(2)+F1(3) is newly started, wherein
total evaporation amount JR=4000 (kg/h)
total load following evaporation amount JG=zero (kg/h).
5) Combination of combustion positions:

F1(1)+F3(1)+F2(1)+F2(2)

In this combination of combustion positions, combustion of F2(1)+F2(2) is newly started, wherein
total evaporation amount JR=3500 (kg/h)
total load following evaporation amount JG=3000 (kg/h).
6) Combination of combustion positions:

F1(1)+F3(1)+F1(2)+F1(3)+F2(1)

In this combination of combustion positions, combustion of F1(2)+F1(3)+F2(1) is newly started, wherein
total evaporation amount JR=5000 (kg/h)
total load following evaporation amount JG=1500 (kg/h).
7) Combination of combustion positions:

F1(1)+F3(1)+F1(2)+F2(1)+F2(2)

In this combination of combustion positions, combustion of F1(2)+F2(1)+F2(2) is newly started, wherein
total evaporation amount JR=4500 (kg/h)
total load following evaporation amount JG=2000 (kg/h).
8) Combination of combustion positions:

F1(1)+F3(1)+F1(2)+F1(3)+F2(1)+F1(2)

In this combination of combustion positions, combustion of F1(2)+F1(3)+F2(1)+F1(2) is newly started, wherein
total evaporation amount JR=6500 (kg/h)
total load following evaporation amount JG=zero (kg/h).

The above combinations of combustion positions 1) to 8) are generated.

(2) Next, when S102 is executed to extract combinations of combustion positions that satisfy total load following evaporation amount JG≥setup load following evaporation amount JT (=3000 (kg/h)), there are extracted three, namely 2), 3) and 5) described above since the setup load following evaporation amount JT is 3000 (kg/h).

(3) Then, when S103 is executed to select a combination of combustion positions that satisfies total evaporation amount JR≥required evaporation amount JN and with which the total evaporation amount JR becomes minimum, 2) is selected of which the total evaporation amount JR is equal to or more than 1800 (kg/h) and thus minimum since the required evaporation amount JN is 1800 (kg/h).

(4) S104 is executed to output a signal to the combustion position F2(1) to start combustion.

As a result, a combination of combustion positions including F1(1)+F2(1)+F3(1) is combusted.

According to the boiler system 1A of the second embodiment, in securing the total load following evaporation amount JG of the group of boilers 2A, combinations of combustion positions (selected boilers and combustion positions) that can be arranged by sequentially moving from among combinations of combustion positions currently combusting are extracted and from among them a combination of combustion positions with which the total evaporation amount JR becomes minimum is selected so that it is possible to suppress excess energy consumption while securing the load following capabilities of the group of boilers 2.

Further, combinations of combustion positions are extracted on the basis of the setup load following evaporation amount JT (or the setup range for the load following evaporation amount) from among combinations of combustion positions that can be arranged by sequentially moving from combustion positions currently combusting, and a combination of combustion positions with which the total evaporation amount JR becomes minimum is selected from among these combinations of combustion positions so that it is possible to easily and effectively select a combination of combustion positions with which the total load following evaporation amount JG is secured and with which the total evaporation amount JR becomes minimum.

Third Embodiment

Next, a boiler system 1B according to the third embodiment of the present invention will now be explained by referring to FIG. 1, FIG. 13 and FIG. 15.

As shown in FIG. 1, the third embodiment differs from the first embodiment in that the boiler system 1B includes a group of boilers 3 instead of the group of boilers 2. Since the remaining arrangements are identical to those of the first embodiment so that the same reference numerals are marked and explanations are omitted.

The group of boilers 3 includes a first boiler 31, a second boiler 32, a third boiler 33 and a fourth boiler 34, and the respective boilers 31 to 34 have four-positions boilers that can be controlled to assume four staged combustion conditions, namely a combustion standstill condition (combustion standstill position), a low combustion condition (first combustion position), an intermediate combustion condition (second combustion position) and a high combustion condition (third combustion position), wherein the second combustion position is defined to be a high efficiency combustion position at which high efficiency combustion can be performed.

The controlling portion 4 selects boilers and combustion positions (including combustion standstill positions) so as to secure a total evaporation amount JR that satisfies the required evaporation amount JN, and a total load following evaporation amount JG that satisfies the setup load following evaporation amount JT in accordance with the priority order that is preliminarily set for the respective boilers.

In this respect, when either one of the total evaporation amount JR that satisfies the required evaporation amount JN and the total load following evaporation amount JG that satisfies the setup load following evaporation amount JT cannot be satisfied, preference is given to the total evaporation amount JR.

The boilers 31 to 34 are arranged in that all boilers that are subject to operation move to the third combustion positions that are higher than the high efficiency combustion position after reaching the second combustion positions (high efficiency combustion positions).

Figure 13:
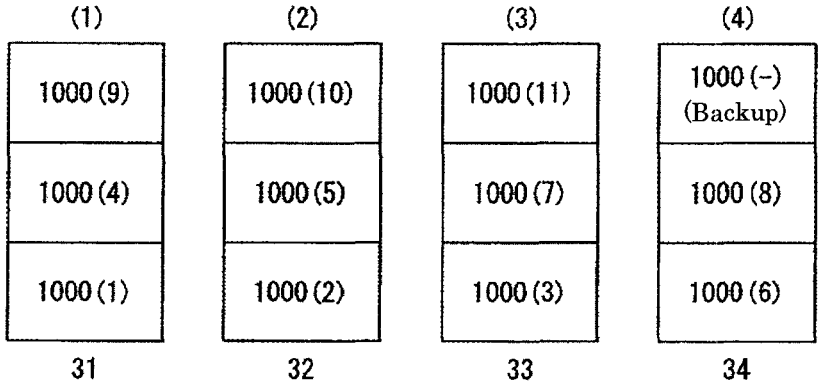
FIG. 13 shows a view for explaining a schematic arrangement and actions of a group of boilers according to the third embodiment.

FIG. 13 is a view for conceptually showing the boilers 31 to 34 constituting the group of boilers 3, wherein the respective frames indicate the respective boilers 31 to 34, frames partitioning the respective boilers 31 to 34 represent respective combustion positions, numbers within ( ) upward of the respective frames indicate priority orders set for the respective boilers 31 to 34 in increasing the evaporation amount, and descriptions (backup) indicate that these combustion positions are reserve cans (combustion positions that are not subject to operation).

It should be noted that in the respective combustion positions, differential evaporation amounts (ΔJR) of the respective combustion positions are indicated and orders of combustion (operation orders) of combustion positions that the controller portion 4 selects in increasing the evaporation amount of the group of boilers 3 by executing the flowchart (FIG. 14) are indicated in ( ) next to the differential evaporation amounts.

The first to fourth boilers 31 to 34 are deemed to have a first differential evaporation amount of 1000 (kg/h), a second differential evaporation amount of 1000 (kg/h), a third differential evaporation amount of 1000 (kg/h) and a rated evaporation amount of 3000 (kg/h), respectively.

Figure 14:
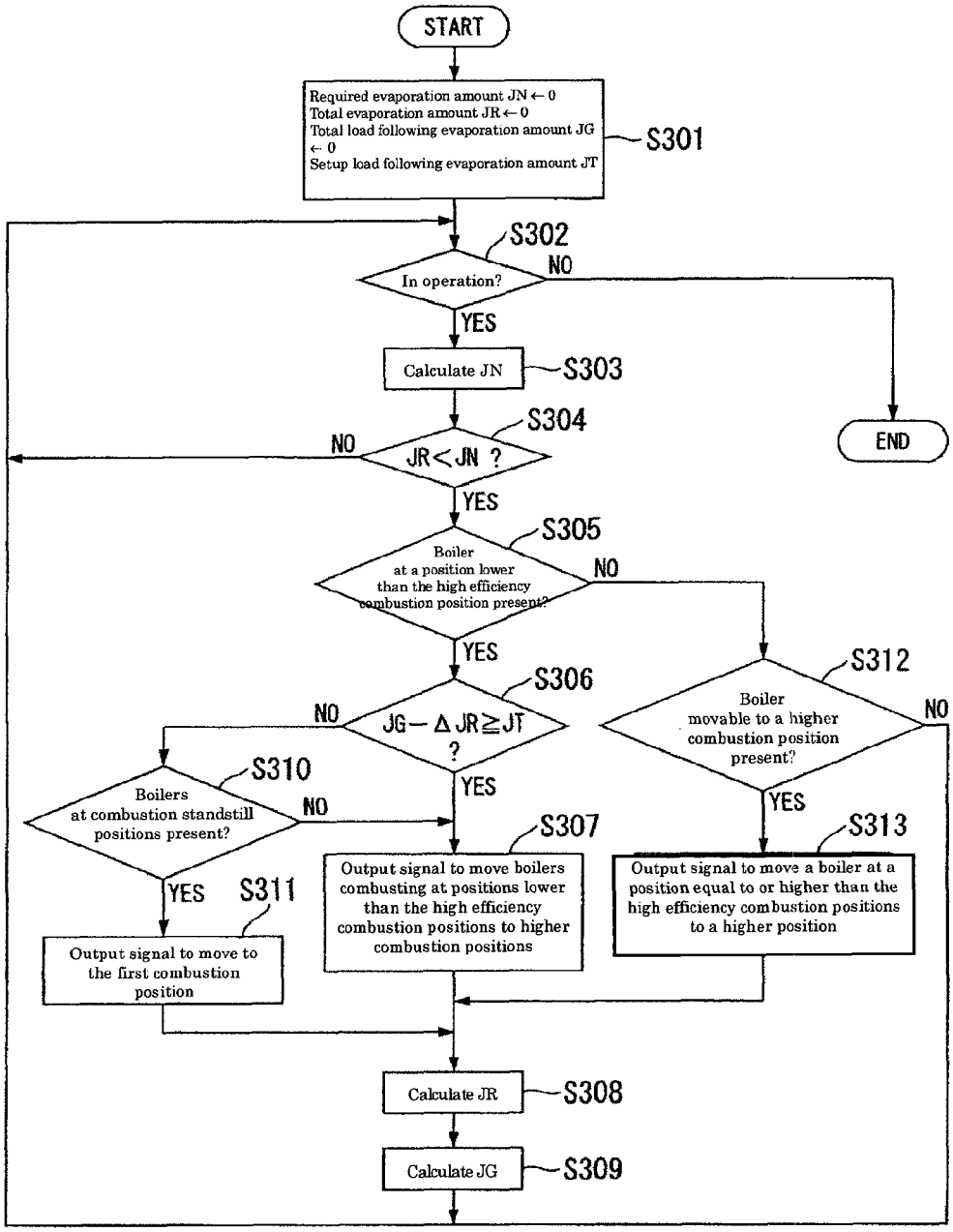
FIG. 14 shows a flowchart for explaining one example of a program according to the third embodiment.
Figure 16:
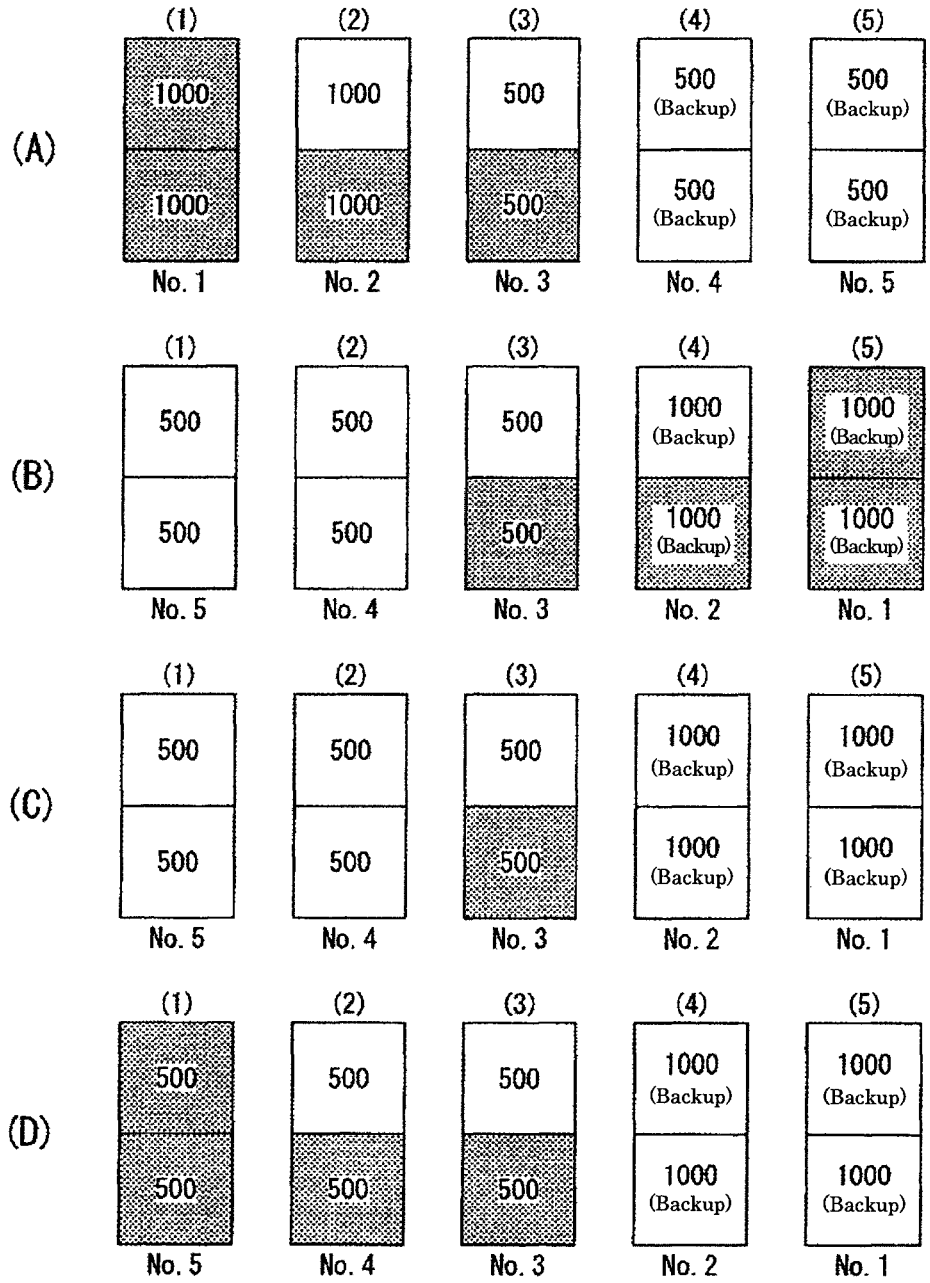
FIG. 16 shows a view for explaining one example of the prior art.

One example of a flow of the program according to the third embodiment will now be explained with reference to FIG. 14. It should be noted that FIG. 14 shows an example of increasing the total evaporation amount JR wherein only one combustion position is moved to the combustion condition at one time (that is, the increase in differential evaporation amount is 1000 (kg/h)) irrespective of the excess or deficiency of the total evaporation amount JR and the total load following evaporation amount JG.

(1) Initial values (=0) are respectively set for the required evaporation amount JN that corresponds to the required load for the group of boilers 3, the total evaporation amount JR that is obtained by summing up the evaporation amounts of the boilers 31 to 34, and the total load following evaporation amount JG obtained by summing up the load following evaporation amounts of the boilers 31 to 34 to set a setup load following evaporation amount JT that the group of boilers 3 is to secure (S301).

(2) It is determined whether the group of boilers 3 is in operation or not (S302).

Where the group of boilers 3 is in operation, the program proceeds to S303, and if it is not in operation, the program is terminated.

(3) The arithmetic portion 43 calculates the required evaporation amount JN (S303). The calculated required evaporation amount JN is stored in the memory 42.

(4) The arithmetic portion 43 compares the required evaporation amount JN calculated in S303 and the total evaporation amount JR stored in the memory 42 to determine whether total evaporation amount JR<required evaporation amount JN is satisfied or not (S304).

Where total evaporation amount JR<required evaporation amount JN is satisfied, the program proceeds to S305, and where total evaporation amount JR<required evaporation amount JN is not satisfied, the program proceeds to S302.

(5) The arithmetic portion 43 determines whether there is a boiler that is at a combustion position lower than the high efficiency combustion position (second combustion position) or at the combustion standstill position and that is movable to a higher combustion position subject to operation that is lower than the high efficiency combustion position. (S305).

Where there is a boiler that is at a combustion position lower than the high efficiency combustion position or at the combustion standstill position and that is movable to a higher combustion position subject to operation that is lower than the high efficiency combustion position, the program proceeds to S306 and where there is not, the program proceeds to S312.

(6) The arithmetic portion 43 determines whether (total load following evaporation amount JG−differential evaporation amount ΔJR≥setup load following evaporation amount JT) is satisfied based on the total load following evaporation amount JG, the differential evaporation amount ΔJR in case a boiler of highest priority order during combustion at a position lower than the high efficiency combustion position is moved to a combustion position higher by one stage obtained from the third database 45C, and the setup load following evaporation amount JT stored in the memory 42 (S306).

Where (total load following evaporation amount JG−differential evaporation amount ΔJR≥setup load following evaporation amount JT) is satisfied, the total load following evaporation amount JG will satisfy the setup load following evaporation amount JT even if a boiler of highest priority order during combustion is moved to a combustion position higher by a one stage so that the program proceeds to S307 to move a boiler during combustion at a position lower than the high efficiency combustion position to a higher combustion position, and where total load following evaporation amount JG−differential evaporation amount ΔJR≥setup load following evaporation amount JT is not satisfied, the program proceeds to S310 to suppress reductions in the load following evaporation amount JG. It should be noted that the program proceeds to S310 also where there is no boiler combusting at a position lower than the high efficiency combustion position.

(7) The arithmetic portion 43 outputs a signal for moving a boiler of highest priority order during combustion at a position lower than the high efficiency combustion position to a combustion position higher by one stage (S307). Upon output of the signal, the program proceeds to S308.

(8) The arithmetic portion 43 calculates the total evaporation amount JR after moving by referring to the third database 45C (S308). The calculated total evaporation amount JR is stored in the memory 42. Upon execution of S308, the program proceeds to S309.

(9) The arithmetic portion 43 calculates the total load following evaporation amount JG by referring to the third database 45C (S309). The calculated total load following evaporation amount JG is stored in the memory 42. Upon execution of S309, the program proceeds to S302.

(10) The arithmetic portion 43 determines whether there is a boiler at a combustion standstill position (S310).

Where there is a boiler at a combustion standstill position, the program proceeds to S311, and where there is no boiler at a combustion standstill position, the program proceeds to S307.

(11) The arithmetic portion 43 outputs a signal for moving a boiler of highest priority order from among boilers in combustion standstill positions to a combustion position higher by one stage (S311). Upon output of the signal, the program proceeds to S308.

(12) The arithmetic portion 43 determines whether there is a boiler combusting at a position that is the high efficiency combustion position or higher and movable to a higher combustion position (S312).

Where there is a boiler combusting at a position that is the high efficiency combustion position or higher and movable to a higher combustion position, the program proceeds to S313, and where there is no boiler that can be moved, the program proceeds to S302.

(13) The arithmetic portion 43 outputs a signal for moving a boiler of highest priority order from among boilers during combustion at a position that is the high efficiency position or higher to a combustion position higher by one stage (S313). Upon output of the signal, the program proceeds to S308.

The above (2) to (13) are repeatedly executed.

FIG. 15 is a table indicating the required evaporation amounts JN, the total evaporation amounts JR and the total load following evaporation amount JG at the time of increasing the total evaporation amount JR in the operating order as shown in FIG. 13 such that the boiler system 1B can correspond to the increase in required evaporation amount JN. Movements of the combustion positions of the group of boilers 3 in accordance with such operations are basically as follows. It should be noted that the setup load following evaporation amount JT of the boiler system 1B is 3500 (kg/h).

(1) First, when the required evaporation amount JN exceeds zero and operation is started, the arithmetic portion 43 sequentially proceeds to S302, S303, S304 and S305 and determines in S305 whether there is a boiler that is at a combustion position lower than the high efficiency combustion position (second combustion position) or at the combustion standstill position and that is movable to a higher combustion position which is equal to or lower than the high efficiency combustion position that is subject to operation, and upon determining that there is a boiler that is at the combustion standstill position and that is movable to a higher combustion position which is equal to or lower than the high efficiency combustion position that is subject to operation, the program proceeds to S306.

Next, in S306, it is determined that there is no boiler during combustion at a position lower than the high efficiency combustion position, and the program proceeds to S310.

Then, since it has been determined in S310 that there is a boiler at the combustion standstill position, the program proceeds to S311, and by executing S311, the first combustion position of the first boiler 31 will be in a combustion condition (operation order 1) whereupon S308 and S398 are executed.

In a condition in which operation order 1 has been executed, the total evaporation amount JR is 1000 (kg/h) and the total load following evaporation amount JG is 2000 (kg/h) so that the total load following evaporation amount JG does not satisfy the setup load following evaporation amount JT (=3500 (kg/h)).

In this embodiment, where any boiler has moved to a higher combustion position to change to a combustion condition that corresponds to an operation order N (in this embodiment, N is an integer from 1 to 11), S302, S303 and S304 are repeated until the required evaporation amount JN has increased to a value corresponding to the next operation order (N+1) such that total evaporation amount JR<required evaporation amount JN in S304 becomes "YES".

(2) Next, where the required evaporation amount JN exceeds, for instance, 1000 (kg/h), S302, S303, S304, S305, S306, S310 and S311 are executed such that the first combustion position of the second boiler 32 will be in a combusting condition (operation order 2) whereupon S308, S309 are executed.

In a condition in which operation order 2 has been executed, the total evaporation amount JR is 2000 (kg/h) and the total load following evaporation amount JG is 4000 (kg/h) so that the total load following evaporation amount JG satisfies the setup load following evaporation amount JT (=3500 (kg/h)).

(3) Then, where the required evaporation amount JN exceeds 2000 (kg/h), S302, S303, S304 and S305 are executed in this order, and upon determining in S305 that there is a boiler combusting at a position lower than the high efficiency combustion position (second combustion position), the program proceeds to S306, and since (total load following evaporation amount JG (=4000 (kg/h))−differential evaporation amount ΔJR when the first boiler 31 is moved to the second combustion position (=1000 (kg/h)) is 3000 (kg/h) in S306 so that (total load following evaporation amount JG−differential evaporation amount ΔJR when the first boiler 31 is moved to the second combustion position) ≥setup load following evaporation amount JT (=3500 (kg/h)) is not satisfied, the program proceeds to S310.

Next, since it has been determined in S310 that there is a boiler at the combustion standstill position, the program proceeds to S311, and by executing S311, the first combustion position of the third boiler 33 is set to a combustion condition (operation order 3), and S308 and S309 are executed thereafter.

In a condition in which operation order 3 has been executed, the total evaporation amount JR is 3000 (kg/h) and the total load following evaporation amount JG is 6000 (kg/h) so that the total load following evaporation amount JG satisfies the setup load following evaporation amount JT (=3500 (kg/h)).

(4) Then, where the required evaporation amount JN exceeds 3000 (kg/h), S302, S303, S304, S305 and S306 are executed in this order, and since (total load following evaporation amount JG (=6000 (kg/h))−differential evaporation amount ΔJR when the first boiler 31 is moved to the second combustion position (=1000 (kg/h)) when the first boiler of highest priority order in S306 is moved to a higher combustion position is 5000 (kg/h) (≥setup load following evaporation amount JT 3500 (kg/h)), the program proceeds to S307. By executing S307, the second combustion position of the first boiler 31 is set to a combustion condition (operation order 4), and S308 and S309 are executed thereafter.

In a condition in which operation order 4 has been executed, the total evaporation amount JR is 4000 (kg/h) and the total load following evaporation amount JG is 5000 (kg/h) so that the total load following evaporation amount JG satisfies the setup load following evaporation amount JT (=3500 (kg/h)).

(5) In operation order 5, when the required evaporation amount JN has exceeded 4000 (kg/h), the second boiler 32 is moved to the second combustion position by executing the same operations as in operation order 4, and in a condition in which operation order 5 has been executed, the total evaporation amount JR is 5000 (kg/h) and the total load following evaporation amount JG is 4000 (kg/h) so that the total load following evaporation amount JG satisfies the setup load following evaporation amount JT (=3500 (kg/h)).

(6) Then, where the required evaporation amount JN exceeds 5000 (kg/h), S302, S303, S304 and S305 are executed in this order, and upon determining in S305 that there is a boiler combusting at a position lower than the high efficiency combustion position, the program proceeds to S306, and since (total load following evaporation amount JG (=4000 (kg/h))−differential evaporation amount ΔJR when the fourth boiler 34 is moved to the second combustion position (=1000 (kg/h)) in S306 is 3000 (kg/h) (<setup load following evaporation amount JT 3500 (kg/h))), the program proceeds to S310.

Next, since it has been determined in S310 that there is a boiler at the combustion standstill position, the program proceeds to S311, and by executing S311, the first combustion position of the fourth boiler 34 is set to a combustion condition (operation order 6), and S308 and S309 are executed thereafter.

In a condition in which operation order 6 has been executed, the total evaporation amount JR is 6000 (kg/h) and the total load following evaporation amount JG is 5000 (kg/h) so that the total load following evaporation amount JG satisfies the setup load following evaporation amount JT (=3500 (kg/h)).

(7) Then, where the required evaporation amount JN exceeds 6000 (kg/h), S302, S303, S304 and S305 are executed in this order, and upon determining in S305 that there is a boiler combusting at a position lower than the high efficiency combustion position, the program proceeds to S306, and since (total load following evaporation amount JG (=5000 (kg/h))−differential evaporation amount ΔJR when the third boiler 33 is moved to the second combustion position (=1000 (kg/h)) is 4000 (kg/h) (≥setup load following evaporation amount JT 3500 (kg/h)) in S306, the program proceeds to S307, and by executing S307, the second combustion position of the third boiler 33 is set to a combustion condition (operation order 7), and S308 and S309 are executed thereafter.

In a condition in which operation order 7 has been executed, the total evaporation amount JR is 7000 (kg/h) and the total load following evaporation amount JG is 4000 (kg/h) so that the total load following evaporation amount JG satisfies the setup load following evaporation amount JT (=3500 (kg/h)).

(8) Then, where the required evaporation amount JN exceeds 7000 (kg/h), S302, S303, S304, S305 and S306 are executed in this order, and since (total load following evaporation amount JG (=4000 (kg/h))−differential evaporation amount ΔJR when the third boiler 33 is moved to the second combustion position (=1000 (kg/h)) is 3000 (kg/h) (<setup load following evaporation amount JT 3500 (kg/h)) in S306, the program proceeds to S310.

Next, it has been determined in S310 that there is no boiler at the combustion standstill position, the program proceeds to S307, and by executing S307, the second combustion position of the fourth boiler 34 is set to a combustion condition (operation order 8), and S308 and S309 are executed thereafter.

In a condition in which operation order 8 has been executed, the total evaporation amount JR is 8000 (kg/h) and the total load following evaporation amount JG is 3000 (kg/h) so that the total load following evaporation amount JG does not satisfy the setup load following evaporation amount JT (=3500 (kg/h)).

(9) Next, where the required evaporation amount JN exceeds 8000 (kg/h), S302, S303, S304 and S305 are executed in this order, and upon determining in S305 that there is no boiler combusting at a position lower than the high efficiency combustion position, the program proceeds to S312.

Since it is determined in S312 that there is a boiler movable to a higher combustion position, the program proceeds to S313, and by executing S313, the third combustion position of the first boiler 31 is set to a combustion condition (operation order 9), and S308 and S309 are executed thereafter.

In a condition in which operation order 9 has been executed, the total evaporation amount JR is 9000 (kg/h) and the total load following evaporation amount JG is 2000 (kg/h) so that the total load following evaporation amount JG does not satisfy the setup load following evaporation amount JT (=3500 (kg/h)).

(10) In operation orders 10 and 11 when the required evaporation amounts JN have exceeded 9000 (kg/h) and 10000 (kg/h), the second boiler 32 and the third boiler 33 are sequentially moved to the third combustion positions by executing the same operations as in operation order 9, and in conditions in which operation orders 10 and 11 have been respectively executed, the total evaporation amounts JR are 10000 (kg/h) and 11000 (kg/h) and the total load following evaporation amounts JG will be 1000 (kg/h) and zero (kg/h), respectively.

The total evaporation amounts JR are increased in accordance with operation orders as indicated in FIG. 13.

The total evaporation amounts JR and the total load following evaporation amounts JG in conditions in which the above operation orders (1 to 11) have been executed are shown, as mentioned above, in FIG. 15.

It should be noted that since the positions are moved to combustion positions higher than the high efficiency combustion positions after executing operation order 8; the total load following evaporation amount JG will be on the decrease only, and while the total load following evaporation amount JG will not satisfy the setup load following evaporation amount JT (=3500 (kg/h)) by executing the operation order 8, operation orders 9 to 11 will be continuously executed since preference is given to total evaporation amount JR≥required evaporation amount JN over total load following evaporation amount JG≥setup load following evaporation amount JT.

According to the boiler system 1B, a minimum total load following evaporation amount JG that satisfies the setup load following evaporation amount JT is secured in securing the total evaporation amount JR of the group of boilers 3 so that it is possible to suppress excess energy consumption by limiting combustion of boilers while securing load following capabilities of the group of boilers 3.

It should be noted that the present invention is not limited to the above embodiments but various changes can be made without departing from the gist of present invention.

For instance, while a case has been explained in the above embodiments in which the group of boilers 2 constituting the boiler system 1 has four three-positions boilers, the group of boilers 2A constituting the boiler system 1A has three dissimilar boilers and the group of boilers 3 constituting the boiler system 1B having four four-positions boilers, the number of boilers constituting the groups of boilers 2, 2A and 3 and arrangements of boilers (for instance, numbers of combustion positions or differential evaporation amounts of respective combustion positions) can be arbitrarily set.

Further, while a case has been explained in the above embodiments in which the second combustion positions of the boilers 31, 32 and 33 constituting the group of boilers 3 are the high efficiency combustion positions, it is possible to arbitrarily define which combustion positions are to be the high efficiency combustion positions, and it is possible to employ arrangements in which the first combustion positions or third combustion positions are the high efficiency combustion positions. It is, for instance, possible to define combustion positions higher than the fourth combustion positions to be the high efficiency combustion positions in boilers with five or more positions.

It is also possible to define combustion positions of different stages as high efficiency combustion positions in the respective boilers.

While a case has been explained in the above embodiments in which a part of the boilers (combustion positions) constituting the groups of boilers 2, 2A and 3 are defined to be reserve cans to cope with breakdowns, repairs, programmed standstills or the like, it is possible to employ an arrangement that does not include any reserve cans.

Further, while a case has been explained in the first embodiment in which settings for reserve cans are maintained without changing the reserve cans where maximum evaporation amount≥setup maximum evaporation amount is satisfied, in setting a setup maximum evaporation amount for the group of boilers, changes or settings of reserve cans can be arbitrarily set such as defining the maximum evaporation amount to be minimum within a range that satisfies maximum evaporation amount≥setup maximum evaporation amount or defining combustion positions of a minimum number of boilers that is capable of outputting the maximum evaporation amount as boilers subject to operation and setting all remaining boilers to be reserve cans.

Further, while a case has been explained in the above embodiments in which in calculating the total load following evaporation amount JG, 1) objects of calculation are evaporation amounts that increase when boilers during combustion are moved to the highest combustion positions of boilers that are subject to operation and evaporation amounts that increase when boilers in steam supply moving processes are moved to the highest combustion positions of boilers that are subject to operation, it is also possible to perform calculation by setting as objects of calculation any one of 2) evaporation amounts that increase when boilers during combustion are moved to the highest combustion positions of boilers, and 3) evaporation amounts that increase when boilers during combustion are moved to the highest combustion positions of boilers and evaporation amounts that increase when boilers in steam supply moving processes are moved to lowest combustion positions of boilers.

In calculating the total load following evaporation amount JG, instead of employing the evaporation amounts that increase when boilers during combustion and boilers in steam supply moving processes are moved to the highest combustion positions of the boilers that are subject to operation, it is possible to calculate, upon defining as objects of calculation evaporation amounts that increase on the premise that any of 1) combustion positions during combustion are moved to combustion position higher by one stage that are subject to operation, 2) positions are moved to preliminarily set combustion positions that are subject to operation higher by several stages, and 3) positions are moved to high efficiency combustion positions.

It is also possible to define as objects of calculation not only combustion positions that are defined to be subject to operation as mentioned above but also combustion positions other than positions that are subject to operation.

While the total load following evaporation amount JG of the groups of boilers 2, 2A and 3 are defined to be equal to or more than the setup load following evaporation amount JT in the above embodiments, it is also possible to define upper limit values and lower limit values of the total load following evaporation amounts JG and to be within a specified setup range for the load following evaporation amounts.

Further, while an example has been explained in which the group of boilers 2 is controlled by setting a setup maximum evaporation amount for the group of boilers 2 such that the maximum evaporation amount becomes equal to or more than the setup maximum evaporation amount, it is also possible to perform operation without setting the setup maximum evaporation amount and to be within a specified range with respect to the setup maximum evaporation amount. Further, where a setup maximum evaporation amount is set, it is possible to perform control to be less than the setup maximum evaporation amount, and it is also possible that the setup maximum evaporation amount is a suitably variable matter of settings.

While an example has been explained in which the evaporation amount is controlled by using the pressure P(t) of steam within the steam header 6 and the target pressure PT as a physical amount that corresponds to the evaporation amount in the above embodiments, it is possible to perform control of the evaporation amount using evaporation amounts such as amount of usage of steam within the steam utilizing equipment 18 and other physical amounts that correspond to the evaporation amount instead of pressure.

While examples of schematic arrangements of programs according to the present invention are shown as flowcharts and block diagrams, the programs can be arranged by methods (algorithms) other than the above flowchart or block diagrams.

While explanations have been made based on a case where the memory medium for storing the programs is a ROM in the above embodiment, it is also possible to employ, besides the ROM, an EP-ROM, a hard disk, a flexible disk, an optical disk, a magneto optical disk, a CD-ROM, a CD-R, a magnetic tape or a non-volatile memory card. Further, the actions of the above embodiments are not only realized by executing the programs read by the arithmetic portion, but also cases in which an OS (operating system) operating in the arithmetic portion performs a part or all of the actual processes based on instructions of the programs to thus realize the above actions of the embodiments thereby are also included. It also goes without saying that the programs readout from the memory medium can be first written into extension boards inserted into the arithmetic portion or memories provided in extension units connected to the arithmetic portion whereupon the extension board or CPUs provided in the extension units perform a part or all of the actual processes based on instructions of the programs to thus realize the above actions of the embodiments thereby.

The invention is industrially applicable since load following capabilities of groups of boilers can be easily secured.

What is claimed is:

1. A controller comprising: a program stored on a non-transitory memory medium, wherein the program is for controlling a group of boilers having boilers with a plurality of staged combustion positions, the program being arranged to control the respective boilers and the combustion positions such that a total load following evaporation amount obtained by summing up the load following evaporation amounts of each of the boilers constituting the group of boilers becomes equal to or more than a setup load following evaporation amount winch is an evaporation amount that is to be followed by the group of boilers.

2. The controller according to claim 1, wherein, in summing up the total load following evaporation amount, the program is arranged to perform calculation with objects of calculation being evaporation amounts that increase when the boilers during combustion are moved from the combustion positions during combustion to the highest combustion positions.

3. The controller according to claim 2, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

4. The controller according to claim 3, wherein, in setting a combination with which the total evaporation amount becomes minimum, the program is arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

5. The controller according to claim 1, wherein, in summing up the total load following evaporation amount, the program is arranged to perform calculation with objects of calculation being evaporation amounts that increase when the boilers during combustion are moved from the combustion positions during combustion to the highest combustion positions and evaporation amounts that increase when boilers during steam supply moving processes are moved to the lowest combustion positions.

6. The controller according to claim 5, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

7. The controller according to claim 6, wherein, in setting a combination with which the total evaporation amount becomes minimum, the program is arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

8. The controller according to claim 1, wherein, in summing up the total load following evaporation amount, the program is arranged to perform calculation with objects of calculation being evaporation amounts that increase when the boilers during combustion are moved from the combustion position during combustion to the highest combustion position and evaporation amounts that increase when the boilers in steam supply moving processes are moved to the highest combustion positions.

9. The controller according to claim 8, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

10. The controller according to claim 9, wherein, in setting a combination with which the total evaporation amount becomes minimum, the program is arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

11. The controller according to claim 1, wherein, in setting high efficiency combustion positions for the respective boilers and calculating the total evaporation amount and the total load following evaporation amount, the program is arranged to perform calculation such that from among boilers that are objects of calculations, boilers that are at combustion positions lower than the high efficiency combustion positions are given priority over boilers that have reached the high efficiency combustion positions.

12. The controller according to claim 1, wherein, the program is arranged to set a setup maximum evaporation amount that the group of boilers should be able to output to correspond to the required load and to set the boilers that are subject to operation and combustion positions such that the maximum evaporation amount that can be output by the group of boilers secures the setup maximum evaporation amount.

13. A boiler system comprising the controller according to claim 1.

14. A controller comprising: a program stored on a non-transitory memory medium, wherein the program is for controlling a group of boilers having boilers with a plurality of staged combustion positions, the program being arranged to control the respective boilers and the combustion positions such that a total load following evaporation amount obtained by summing up the load following evaporation amounts of each of the boilers constituting the group of boilers is within a setup range for a load following evaporation amount of an evaporation amount that is to be followed by the group of boilers.

15. The controller according to claim 14, wherein, in summing up the total load following evaporation amount, the program is arranged to perform calculation with objects of calculation being evaporation amounts that increase when the boilers during combustion are moved from the combustion positions during combustion to the highest combustion positions.

16. The controller according to claim 15, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

17. The controller according to claim 16, wherein, in setting a combination with which the total evaporation amount becomes minimum, the program is arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

18. The controller according to claim 14, wherein, in summing up the total load following evaporation amount, the program is arranged to perform calculation with objects of calculation being evaporation amounts that increase when the boilers during combustion are moved from the combustion positions during combustion to the highest combustion positions and evaporation amounts that increase when boilers during steam supply moving processes are moved to the lowest combustion positions.

19. The controller according to claim 18, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

20. The controller according to claim 19, wherein, in setting a combination with which the total evaporation amount becomes minimum, the program is arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

21. The controller according to claim 14, wherein, in summing tip the total load following evaporation amount, the program is arranged to perform calculation with objects of calculation being evaporation amounts that increase when the boilers during combustion are moved from the combustion position during combustion to the highest combustion position and evaporation amounts that increase when the boilers in steam supply moving processes are moved to the highest combustion positions.

22. The controller according to claim 21, wherein, in increasing the evaporation amount of the group of boilers, the program is arranged to control the respective boilers and the combustion positions, such that a total evaporation amount which is obtained by a combination of combustion positions during combustion and combustion positions that have been selected from among combustion positions to which it is possible to sequentially move from the combustion positions during combustion becomes minimum.

23. The controller according to claim 22, wherein, in setting a combination with which the total evaporation amount becomes minimum, the program is arranged to select combinations of combustion positions during combustion and combustion positions that have been selected from among combustion positions to which it is possible to sequentially move from the combustion positions during combustion from among combinations that have been extracted on the basis of the setup load following evaporation amount or the setup range of the load following evaporation amount and to control the respective boilers and the combustion positions.

24. The controller according to claim 14, wherein, in setting high efficiency combustion positions for the respective boilers and calculating the total evaporation amount and the total load following evaporation amount, the program is arranged to perform calculation such that from among, boilers that are objects of calculations, boilers that are at combustion positions lower than the high efficiency combustion positions are given priority over boilers that have reached the high efficiency combustion positions.

25. The controller according to claim 14, wherein, the program is arranged to set a setup maximum evaporation amount that the group of boilers should be able to output to correspond to the required load and to set the boilers that are subject to operation and combustion positions such that the maximum evaporation amount that can be output by the group of boilers secures the setup maximum evaporation amount.

26. A boiler system comprising the controller according to claim 14.

* * * * *